US008261508B2

(12) United States Patent
Thiers

(10) Patent No.: US 8,261,508 B2
(45) Date of Patent: Sep. 11, 2012

(54) FLOOR PANEL AND FLOOR COVERING CONSISTING OF SUCH FLOOR PANELS

(75) Inventor: Bernard Paul Joseph Thiers, Eine (BE)

(73) Assignee: Flooring Industries Limited, Sarl, Bertrange (LU)

( * ) Notice: Subject to any disclaimer, the term of this patent is extended or adjusted under 35 U.S.C. 154(b) by 450 days.

(21) Appl. No.: 12/445,469

(22) PCT Filed: Oct. 29, 2007

(86) PCT No.: PCT/IB2007/003310

§ 371 (c)(1),
(2), (4) Date: Apr. 14, 2009

(87) PCT Pub. No.: WO2008/053333

PCT Pub. Date: May 8, 2008

(65) Prior Publication Data

US 2010/0018149 A1 Jan. 28, 2010

(30) Foreign Application Priority Data

Oct. 31, 2006 (BE) ..... 2006/0534
Mar. 27, 2007 (BE) ..... 2007/0154

(51) Int. Cl.
*E04F 15/02* (2006.01)

(52) U.S. Cl. ..... 52/592.1; 52/588.1; 428/192

(58) Field of Classification Search ..... 52/588.1, 52/592.1
See application file for complete search history.

(56) References Cited

U.S. PATENT DOCUMENTS

| | | | | |
|---|---|---|---|---|
| 5,165,816 | A * | 11/1992 | Parasin | 403/334 |
| 5,647,184 | A * | 7/1997 | Davis | 52/592.1 |
| 5,819,491 | A * | 10/1998 | Davis | 52/592.1 |
| 6,006,486 | A * | 12/1999 | Moriau et al. | 52/589.1 |
| 6,098,365 | A * | 8/2000 | Martin et al. | 52/592.1 |
| 6,199,340 | B1 * | 3/2001 | Davis | 52/592.1 |
| 6,526,719 | B2 * | 3/2003 | Pletzer et al. | 52/592.2 |
| 6,675,544 | B1 * | 1/2004 | Ou et al. | 52/539 |
| 6,769,219 | B2 * | 8/2004 | Schwitte et al. | 52/592.1 |
| 6,851,241 | B2 | 2/2005 | Pervan | |
| 6,880,305 | B2 * | 4/2005 | Pervan et al. | 52/480 |

(Continued)

FOREIGN PATENT DOCUMENTS

DE 10233105 A1 2/2004

(Continued)

OTHER PUBLICATIONS

International Search Report and Written Opinion in PCT/IB2007/003310, Aug. 12, 2008.

*Primary Examiner* — Robert Canfield
(74) *Attorney, Agent, or Firm* — Bacon & Thomas, PLLC

(57) ABSTRACT

Floor panel of the type having, at least at two opposite sides, coupling means enabling two of such floor panels to be locked in a mutual position at which the upper edges of the respective floor panels are located substantially in the same horizontal plane, with a space being present at the level of the upper edges between the respective sides and where the respective coupled floor panels in said mutual position are mutually locked free from play at least in the horizontal direction. The space between the sides defines a mutual distance of one to three millimeters between the upper edges.

17 Claims, 13 Drawing Sheets

U.S. PATENT DOCUMENTS

| | | | | |
|---|---|---|---|---|
| 6,880,307 | B2 * | 4/2005 | Schwitte et al. | 52/592.1 |
| 6,898,913 | B2 * | 5/2005 | Pervan | 52/589.1 |
| 6,922,965 | B2 * | 8/2005 | Rosenthal et al. | 52/592.1 |
| 7,003,924 | B2 * | 2/2006 | Kettler et al. | 52/578 |
| 7,621,094 | B2 * | 11/2009 | Moriau et al. | 52/588.1 |
| 7,634,887 | B2 * | 12/2009 | Moriau et al. | 52/588.1 |
| 2002/0007609 | A1 | 1/2002 | Pervan | |
| 2002/0014047 | A1 | 2/2002 | Thiers | |
| 2002/0020127 | A1 | 2/2002 | Thiers et al. | |
| 2002/0056245 | A1 | 5/2002 | Thiers | |
| 2006/0064940 | A1 | 3/2006 | Cappelle | |
| 2006/0236630 | A1 * | 10/2006 | Moriau et al. | 52/384 |
| 2008/0005999 | A1 * | 1/2008 | Pervan | 52/589.1 |
| 2008/0168737 | A1 * | 7/2008 | Pervan | 52/589.1 |
| 2009/0260313 | A1 * | 10/2009 | Segaert | 52/592.1 |
| 2010/0088993 | A1 * | 4/2010 | Grafenauer | 52/588.1 |
| 2010/0186337 | A1 * | 7/2010 | Barretto | 52/588.1 |
| 2011/0011026 | A1 * | 1/2011 | Cappelle et al. | 52/588.1 |

FOREIGN PATENT DOCUMENTS

| | | | |
|---|---|---|---|
| DE | 202005006559 | U1 | 8/2005 |
| EP | 1 640 530 | A2 | 3/2006 |
| GB | 2 256 023 | A | 11/1992 |
| JP | 8109734 | A | 4/1996 |
| WO | 9426999 | A1 | 11/1994 |
| WO | 9747834 | A1 | 12/1997 |
| WO | 0196688 | A1 | 12/2001 |
| WO | 0198603 | A2 | 12/2001 |
| WO | 03/087498 | A1 * | 10/2003 |
| WO | 03087497 | A1 | 10/2003 |
| WO | 2004/063491 | A1 * | 7/2004 |
| WO | 2004081316 | A1 | 9/2004 |
| WO | 2005068747 | A1 | 7/2005 |
| WO | 2006063803 | A2 | 6/2006 |
| WO | 2006066639 | A1 | 6/2006 |
| WO | 2006074824 | A2 | 7/2006 |
| WO | 2006090287 | A1 | 8/2006 |
| WO | 2007072198 | A2 | 6/2007 |
| WO | 2007080449 | A2 | 7/2007 |
| WO | 2007113676 | A2 | 10/2007 |
| WO | 2008/053333 | A2 * | 5/2008 |
| WO | 2009/016446 | A2 * | 2/2009 |

* cited by examiner

FLOOR PANEL AND FLOOR COVERING CONSISTING OF SUCH FLOOR PANELS

BACKGROUND

1. Field of the Invention

This invention relates to floor panels, as well as to floor coverings composed of such floor panels.

2. Related Art

More particularly, the invention relates to floor panels intended for forming a floating floor covering and which, during installation, may be coupled to each other at their edges by means of mechanical coupling parts, whether or not made in one piece with the floor panel, which provide for a mutual locking of the floor panels in horizontal as well as in vertical direction, for example, such as described in the International Patent Applications WO 94/26999, WO 97/47834, WO 01/98603 and WO 01/96688.

The floating installation of floor panels allows a free expansion or shrinkage of the floor covering with a changing environmental climate. In order to allow for expansion, the floor covering is installed up to a certain distance, in the order of magnitude of 1 centimeter, from the wall of a room. The space thus kept free at the edge of the room, currently called expansion gap, usually is covered by a finishing profile or end profile. With the existing floating floor coverings, it is recommended to apply such expansion gaps in the floor surface, too, when the surface of the floor covering becomes too large and, for example, exceeds the distance of 12 meters in longitudinal or transverse directions. For covering an expansion gap in the surface of the floor covering also a finishing profile, more particularly an expansion profile, is applied. Said end profiles and expansion profiles are described, for example, in WO 2006/074824. Said finishing profiles, and then in particular said expansion profiles situated in the surface of the floor covering, are experienced by the user as disturbing, as they interrupt the floor surface by protruding above the floor surface and usually have other dimensions than the floor panels themselves. There is a desire to avoid or to restrict the application of such profiles, as well as there is the desire to limit the dimensions of the required expansion gap.

With a changing environmental climate, floatingly installed floor coverings moreover show further disadvantages in the case that heavy loads, such as furniture, are placed upon the floor surface. Such loads in fact may hinder or prevent the free expansion and/or shrinkage of the floor. Such hindrance or prevention may result in the unlocking of floor panels in the floor covering when shrinking and in the warping of the floor covering when expanding.

From the state of the art, several suggestions are known in order to fully or partially avoid the problems outlined above and/or to fully or partially meet the desires outlined above.

The solutions presented in WO 94/26999, WO 2005/068747 and WO 2006/066639 respectively relate to floor panels which can be coupled at their sides by means of mechanical coupling parts provided with a certain built-in play. This play can provide for a mutual freedom of movement between the coupled floor panels. Another example of such coupling is known from WO 2004/081316. In this latter document, the space of the play, however, is filled with a sealing material having no mechanical strength. However, in the suggestions in each of the herein-mentioned international applications, there is the risk that floor panels initially are installed in a position in which the upper edges of the floor panels concerned already are touching, such that, in case of a possible expansion, they can not move farther towards each other and the suggested solution may solely be active in a situation where the floor panels move away from each other, such as during shrinking. The reverse is possible, too, namely that the floor panels are installed in an initial mutual position in which they can not move farther away from each other, for instance, when shrinking.

From document JP 8-109734, it is known to implement mechanical coupling parts such that the floor panels initially always are installed such that there is an intermediate space at the height of the upper edges of the coupled floor panels, between the respective coupled sides. With the floor panels known from this document, it is always possible to counterbalance an expansion of the floor panels to a certain extent, or, in other words, it is always possible to allow a movement of the coupled floor panels towards each other to a certain extent. However, with the solution proposed in this document, it is impossible to counterbalance shrinkage of the floor panels.

SUMMARY OF THE DISCLOSURE

According to its first aspect, the present invention aims at a floor panel offering an alternative solution for at least one of the herein above-described problems and/or may fully or partially fulfill at least one of the herein above-described desires in the utilization of floating floor coverings. The floor panel of the invention may even result in lesser problems with expansion and shrinkage of a loaded floor covering in comparison with the floor panels of the state of the art. To this aim, the invention according to its first aspect relates to a floor panel of the type having, at least at two opposite sides, coupling means allowing that two of such floor panels can cooperate with each other, wherein these coupling means preferably are made in one piece with the floor panel, and wherein these coupling means, in a coupled condition of two of such floor panels, provide for a locking in a vertical direction perpendicular to the plane defined by the coupled floor panels, as well as in a horizontal direction perpendicular to the respective sides and in the plane of the coupled floor panels, with as a characteristic that said coupling means comprise positioning means, more particularly positioning portions, wherein these positioning means urge, bring, respectively, two of such floor panels during coupling into an initial locked mutual position, wherein the coupled floor panels may leave the aforementioned initial mutual position by shifting in a locked condition in horizontal direction towards each other or away from each other, and that said coupling means, when the coupled floor panels leave said initial mutual position, in a movement towards each other as well as in a movement away from each other, provide for a restoring force to said initial mutual position.

It is clear that the possibility to bring the floor panels, by means of the positioning means, more particularly by means of the positioning portions, into an initially coupled position in which they can move away from each other as well as towards each other, provides for that a floor covering composed of such floor panels can beneficially counterbalance both expansion and shrinkage of the floor panels to a certain extent.

Said coupling means substantially may be made as a tongue and a groove, the latter being bordered by means of a lower lip and an upper lip, which effect said locking in vertical direction. Such coupling means, more particularly coupling parts, preferably also comprise locking means or locking portions cooperating with each other, which effect said horizontal locking.

Preferably, said positioning means are formed by mutually cooperating positioning surfaces, which comprise sloping portions defining tangent lines, said tangent lines each forming an angle with the plane of the floor panel.

According to a particular variant of the first aspect, said coupling means, instead of being made entirely in one piece with the floor panel, are made only substantially in one piece therewith, and the positioning means are at least partially formed of a separate material.

With the same intention as with the first aspect, the present invention, according to an independent second aspect, also relates to a floor panel of the type having, at least at two opposite sides, coupling means allowing that two of such floor panels can cooperate with each other, which substantially are made in the form of a tongue and a groove, the latter being bordered by means of a lower lip and an upper lip, and which, in the coupled condition of two of such floor panels, provide for a locking in a vertical direction perpendicular to the plane defined by the coupled floor panels, wherein said coupling means also comprise locking means, which, in a coupled condition of two of such floor panels, provide for a locking in a horizontal direction perpendicular to the respective sides and in the plane of the coupled floor panels, with as a characteristic that said coupling means are provided with positioning portions, amongst which at least a positioning portion on one of said lips, and a positioning portion cooperating therewith on said tongue, wherein said positioning portions cooperate in such a manner that, when coupling two of such floor panels, an initial locked mutual position is obtained, wherein the coupled floor panels can leave said initial mutual position by shifting in a locked position in horizontal direction towards each other as well as by shifting away from each other, and that said cooperating positioning portions show at least a first pair of mutually cooperating positioning surfaces, by means of which a restoring force towards the initial mutual position is exerted when the coupled floor panels, from said initial position, move towards each other.

It is clear that also a floor covering composed of floor panels with the characteristics of the second aspect has a beneficial behavior in case of a changing environmental climate and/or with the occurrence of shrinkage or expansion of the floor panels.

In the most preferred form of embodiment of such floor panel, there also is a restoring force to the initial position when the coupled floor panels move away from each other from said initial position. In such case, said cooperating positioning portions preferably also have a second pair of mutually cooperating positioning surfaces, by means of which said restoring force to the initial position is exerted, when the coupled floor panels move away from each other from their initial position.

The restoring force mentioned in the second aspect preferably manifests itself as said floor panels leave the initially locked position. This may be achieved, for example, in an embodiment in which said first pair and second pair of mutually cooperating positioning surfaces directly adjoin each other in the initial mutual position. However, it is clear that according to the second aspect, it is not excluded that a space is present at least between one of said pairs of mutually cooperating positioning surfaces in said initial mutual position.

Said lip comprising said positioning portion may contribute to said restoring force by means of an elastic bending. For example, said lip, in said initial mutual position, may or may not be in a bent-out condition and the bending of the lip may increase or start when the coupled floor panels leave the initial mutual position.

There are various possibilities for the implementation of said positioning means. For example, the positioning portions may comprise at least a protrusion at the underside of said tongue and a recess in the upper side of said lower lip and/or comprise an upward-directed portion at the upper side of the lower lip and a portion, cooperating therewith, at the underside of the tongue.

According to a third independent aspect, the present invention relates to a floor panel of the type having, at least at two opposite sides, coupling means allowing that two of such floor panels can cooperate with each other, which substantially are made in the form of a tongue and a groove, the latter being bordered by means of a lower lip and an upper lip, and which, in a coupled condition of two of such floor panels, provide for a locking in a vertical direction perpendicular to the plane defined by the coupled floor panels, wherein said coupling means also comprise locking means, which, in a coupled condition of two of such floor panels, provide for a locking in a horizontal direction perpendicular to the respective sides and in the plane of the coupled floor panels, wherein at least one of said lips bordering said groove is elastically bendable, with as a characteristic that said locking means cooperate in such a manner that, when coupling two of such floor panels, an initial locked mutual position is obtained, wherein the coupled floor panels can leave said initial mutual position by shifting in a locked condition in horizontal direction towards each other as well as shifting away from each other, and that at least said bendable lip and possibly said cooperating locking means provide for a restoring force towards said initial position when the coupled floor panels leave said initial mutual position, with a movement towards each other as well as with a movement away from each other.

The inventors have found that the bending ability of at least one of the lips, preferably the lower lip, bordering the groove may be applied for providing a restoring force towards an initial position. According to various forms of embodiment of the present invention, this finding may lead to an efficient and/or effective absorbance of forces resulting from shrinkage or expansion of the floor panels in a floor covering.

Said locking means preferably consist at least of a locking element which is present in or on said elastically bendable lip and a locking element, cooperating therewith, which is present in or on the tongue.

In a preferred form of embodiment of the third aspect, said elastically bendable lip already is in said initial mutual position in a bent-out condition. Still better, said bending of this lip increases when the coupled floor panels leave the initial mutual position. It is clear that for said increase of the bending, it is not required that there is already a bending in the initial mutual position.

According to its fourth independent aspect, the invention also relates to a floor panel of the type having, at least at two opposite sides, coupling means allowing that two of such floor panels can cooperate with each other, wherein these coupling means, in a coupled condition of two of such floor panels, provide for a locking in a vertical direction perpendicular to the plane defined by the coupled floor panels, as well as in a horizontal direction perpendicular to the respective sides and in the plane of the coupled floor panels, wherein said coupling means allow that two of such floor panels can be locked in a mutual position in which the upper edges of the respective floor panels substantially are situated in the same horizontal plane, whereas at the height of these upper edges, between the respective sides, a space is present, with as a characteristic that the respective coupled floor panels in said mutual position are mutually locked in said horizontal direction free from play, and that said space defines a mutual distance of one to three millimeters between said upper edges. This particular combination between a connection that is free from play in horizontal direction, and a space S that is considerably larger than the play interspace known from the state of the art, for example, from WO 94/26999, may offer special effects. Namely, by means of such floor panels, coupling means, respectively, it is possible to compose floor coverings in a repeatable manner, which floor coverings approach the appearance of a plank floor, with gaps between the planks.

Although the floor panels of the fourth aspect can be connected free from play at least in horizontal direction, it is possible, for example, when such floor panel also shows the characteristics of the first and/or the second and/or the third aspect, that the dimensions of the space S, for example, by the effect of changing climatic circumstances, change after a certain time. According to a first preferred embodiment of the fourth aspect, in order to counteract too large a change, it is preferred that said coupling means comprise stop portions which prevent a possible closing of said space. By closing, here a complete closing or disappearance of the respective space is meant. However, within the scope of the invention, it is also possible to provide means which restrict a possible diminishing of the distance between the respective upper edges to a minimum value for the space. Such minimum value preferably is chosen such that the respective space remains visible and thus preferably is chosen larger than 0.3 millimeters, or still better is chosen, for example, larger than 0.5 or 1 millimeter.

According to a second preferred embodiment of the fourth aspect of the invention, the floor panels in said mutual position, in which the space defines a mutual distance of one to three millimeters between the upper edges, have the feature that from this mutual position, they can not or hardly move towards each other. This may be obtained, for example, in that contact surfaces are present in this mutual position, for example, above a possible tongue and groove, however, beneath the upper surface of the floor panels, which, when the tongue tends to shift further into the groove, are pushed against or into each other at least in horizontal direction without thereby creating a bending or other deformation of the coupling means, which might allow a shrinkage of said space. With a floor covering that is composed of such floor panels, it is to be expected that the variation of the size of the gaps in the course of time will change little or not at all. Preferably, a possible change in the dimensions of the gaps remains restricted to 0.2 millimeters.

It is noted that with the floor panels of the invention, in which a relatively large intentional space is sought, for example, a space defining a distance of 1 to 3 mm between the upper edges, the influence of a possible shrinkage or expansion of the floor panels will not or almost not be observed. In fact, it is possible that this just results in a minimum alteration of the dimensions of the gap that is already present intentionally. For the manufacturer of such floor panels, it is possible to include the size of the gap into the design process and possibly to adapt it depending on the size of the floor panels, the represented material and the tint of the decor, the side where such gap is applied, and the like. Such design process is feasible in the case of both here-above mentioned preferred embodiments. In the case of the first preferred embodiment, the stop portions must be designed such that they allow only a limited movement of the floor panels towards each other.

In said mutual position, the respective coupled floor panels preferably also are mutually locked in a manner free from play at least in said vertical direction, and still better even in all directions perpendicular to the respective side.

As aforementioned, the floor panels of the fourth aspect may also show the characteristics of the first and/or the second and/or the third aspect. To this end, said coupling means may comprise positioning means, wherein these positioning means always urge, bring, respectively, two of such floor panels during coupling into an initial locked mutual position, wherein the coupled floor panels may leave said initial mutual position by shifting in a locked condition in horizontal direction towards each other or away from each other. It is self-evident that for such coupling means, use can be made of the coupling means applied in preceding aspects of the invention.

According to a fifth independent aspect, the invention relates to a floor panel of the type having, at least at two opposite sides, coupling means allowing that two of such floor panels can cooperate with each other, wherein these coupling means substantially are made as a tongue and a groove, the latter being bordered by means of a lower lip and an upper lip, and wherein these coupling means also comprise locking means consisting at least of a locking element, which is present in or on said lips, and a cooperating-therewith locking element, which is present in or on said tongue, wherein said coupling means, in a coupled condition of two of such floor panels, provide for a locking in a vertical direction (V1) perpendicular to the plane defined by the coupled floor panels, as well as in a horizontal direction perpendicular to the respective sides and in the plane of the coupled floor panels, wherein said coupling means allow that two of such floor panels can be locked in a mutual position in which the upper edges of the respective floor panels substantially are situated in the same horizontal plane, whereas a space is present between the respective sides, wherein this space flanks the distal extremity of said upper lip and thereby extends from the upper surface of the respective floor panels up to the tongue, with as a characteristic that said space defines a mutual distance of one to three millimeters between said upper edges and that said coupling means comprise stop portions which prevent a possible closing of said space. It is clear that the stop portions preferably are made such that a minimum space is guaranteed. Preferably, such minimum space defines a distance of minimum 0.3 millimeters between the upper edges of the floor panels, still better a space of at least 0.5 or 1 millimeter is guaranteed. According to said fourth aspect, a constant deep gap between the respective sides of the respective floor panels in a floor covering may be preserved, which may promote the imitation of an old plank floor by means of such floor panels to a large extent. Of course, other particular effects or advantages are not excluded. So, for example, the size of said space, as also mentioned in connection with certain preferred embodiments of the fourth aspect, may be included into the design process.

According to this fifth aspect, said coupling means may comprise positioning means, wherein these positioning means during coupling always urge, bring, respectively, two of such floor panels into an initial locked mutual position, wherein the coupled floor panels can leave said initial mutual position by shifting in a locked condition in horizontal direction towards each other or away from each other. The presence of such positioning means prevents making mistakes when installing the floor panels, whereas these floor panels still can expand and/or shrink. Of course, here the prior-described coupling means and/or positioning means may be applied.

Preferably, the respective coupled floor panels in said mutual position are locked with each other free from play at least in said vertical and/or horizontal directions, and preferably even in all directions perpendicular to the respective side.

According to a sixth independent aspect, the present invention relates to a floor panel of the type having, at least at two opposite sides, coupling means allowing that two of such floor panels can cooperate with each other, wherein said coupling means, in a coupled condition of two of such floor panels, provide for a locking in a vertical direction perpendicular to the plane defined by the coupled floor panels as well as in a horizontal direction perpendicular to the respective sides and in the plane of the coupled floor panels, with as a characteristic that said coupling means comprise positioning means, wherein these positioning means always urge, bring, respectively, two of such floor panels during coupling into an initial locked mutual position, wherein the coupled floor panels can leave said initial mutual position by shifting in a locked condition in horizontal direction towards each other or away from each other, and that in said initial locked position, the upper edges of the respective floor panels substantially are situated in the same horizontal plane, whereas a space is present between the respective sides. It is clear that by means of floor panels with the characteristics of the sixth aspect, a floor covering may be faultlessly composed in which spaces are situated between adjacent floor panels.

Said space may define a mutual distance of one to three millimeters between said upper edges. In such case, it may convincingly form gaps between the separate floor panels.

Said space may also define a mutual distance between said upper edges which is smaller than 0.3 millimeters. In such case, it is hardly or even not at all visible, however, still operative as an expansion gap.

Preferably, the respective coupled floor panels are locked with each other free from play in said mutual position at least in said vertical and/or horizontal direction, and preferably even in all directions perpendicular to the respective side.

According to a seventh independent aspect, the present invention relates to a floor panel of the type having, at least at two opposite sides, coupling means allowing that two of such floor panels can cooperate with each other, and allowing that two of such floor panels may adopt at least two different mutual locked positions, wherein in these two mutual positions there is a locking present respectively in a vertical direction perpendicular to the plane defined by the coupled floor panels, as well as in a horizontal direction perpendicular to the respective sides and in the plane of the coupled floor panels, with as a characteristic that said coupling means comprise positioning means, wherein these positioning means prevent that two of such floor panels, when they are in a first or in a second of said two different mutual positions, leave this first, second, respectively, mutual position by shifting in a locked condition in horizontal direction towards each other or away from each other, and that in said first mutual position, a space is present between the respective sides, which space is at least larger than the possible space in said second mutual position. Such floor panel leaves the choice to the user of composing the floor panels with a larger or smaller, or possibly without any, space in order to form a floor covering. For the manufacturer, this means a possible stock reduction, as he will be able, solely by means of the floor panels with the characteristics of the seventh aspect, to offer two types of floor coverings, namely one type with a certain space size and another type with a smaller, possibly invisible gap, or even without any such space.

Preferably, the respective floor panels, in said first and/or second mutual position, are connected to each other free from play.

In said first mutual position, said space may define a mutual distance of one to three millimeters between said upper edges. In the above-mentioned second mutual position, it may then define a mutual distance between said upper edges, which is smaller than 0.3 millimeters.

It is clear that said space does not necessarily have to be present as a gap in the floor covering. According to a variant, such space also may be filled up entirely or partially with a, whether or not decorative, substance or strip. So, for example, a rubber strip may be provided between the respective upper edges, at least in said first mutual position, such that a so-called ship's deck floor is obtained. According to this variant, the choice between a ship's deck floor and a floor with large or small, or possibly without, gaps may be entirely left to the user. According to this variant, the respective substance or strip with which the space is filled up, may also have sealing, for example, waterproofing or water-repellent, features.

According to an eighth independent aspect, the present invention relates to a floor panel of the type having, both at a first and at a second pair of opposite sides, coupling means allowing that two of such floor panels can cooperate with each other, wherein these coupling means, in a locked condition of the respective sides, provide for a locking in a vertical direction perpendicular to the plane defined by the coupled floor panels, as well as in a horizontal direction perpendicular to the respective sides and in the plane of the coupled floor panels, with as a characteristic that in said coupled condition, a space is present at the opposite sides of said first pair between the respective upper edges, which is at least larger than the possible space existing at the opposite sides of said second pair between the respective upper edges. The combination of larger and smaller gaps creates a number of new possibilities, as will become clear in the following.

According to a particularly preferred embodiment of the eighth aspect, the floor panel is rectangular and oblong, whereby preferably the opposite sides of the first pair form the long sides of the floor panel, whereas the opposite sides of the second pair form the short sides of the floor panel. With such floor panel, it is possible to emphasize the long or the short sides by means of said larger space and/or by adapting the expansion gap, depending on whether the short or the long side is concerned.

Said space which, in the coupled condition, is situated at the opposite sides of the first pair, preferably defines a mutual distance of one to three millimeters between said respective upper edges.

Said space, which, in the coupled condition, is situated at the opposite sides of the second pair, preferably defines a mutual distance which is smaller than 0.3 millimeters. It may be possible to bring this mutual distance at the second pair to below 0.2 millimeters or even to bring it down to zero.

According to said particularly preferred embodiment of the eighth aspect, it is possible that at the short sides a larger expansion gap is provided than at the long sides. This possibility is of importance when for the construction of the floor panel substantially a material is used having, according to all directions in the plane of the floor covering, an almost equal dimensional deformation per length unit. In such case, the shortest deformation will manifest itself anyway at the short sides of the floor panel.

According to a particular variant, amongst others, according to this eighth aspect, but also according to all other aspects of the invention, one may in fact work with floor panels which substantially are constructed of a material having at least one direction in which, under the influence of temperature changes and/or changes in air humidity, it shows less dimensional deformations, such as expansion or shrinkage, than in other directions. Preferably, said direction in which said dimensional deformations are minimal, is coextensive with the direction of said first pair of opposite sides, or more particularly with the longitudinal direction, in case that this variant is applied in combination with the above particularly preferred embodiment of the eighth aspect. Such material then may substantially consist of fibers, such as wood fibers. Fibers have the tendency to deform solely in radial direction and not, or at least less, in longitudinal direction. Of course, solid wood is the recommended material for implementing this particular variant of the invention.

As becomes evident from the above, preferably, according to all aspects of the present invention, in said initially locked mutual position of the floor panels, a space, preferably a well-defined space, is present at the height of the upper edges of the coupled floor panels, between the respective coupled sides. By a "space" at the height of the upper edges, a space is meant allowing that the respective floor panels may move towards each other from their initial locked mutual position. Thus, this is not a local recess of limited height at the upper edge or a chamfer, such as those known from WO 01/96688. Rather, this relates to the absence of horizontally active contact surfaces between both floor panels, which prevent a movement of the floor panels from the initial mutual position towards each other. By a "well-defined space" is meant that the space obtained in the initially coupled position is unambiguously, a possible deviation of 10 percent taken into account, determined by the geometry of the positioning means and/or the coupling means. It is noted that after a certain time also a loss of such unambiguousness may occur as a result of, for example, wear in the coupling means and/or in the positioning means. Such wear may occur, for example, when repeatedly coupling the floor panels. In the sense of the present invention, however, the unambiguousness when coupling the floor panels for the first time is meant.

It is evident that there where a restoring force is mentioned, this force, according to the invention, preferably occurs before the floor panels have moved so far away from each other that they unlock, and/or before the floor panels are moved up to their mutually closest position, respectively, for example, before they have moved so close to each other that said space has disappeared. According to all aspects of the present invention and/or its preferred forms of embodiments, the possible restoring force has a self-centering or self-positioning effect, as it urges the floor panels, when they leave the initial locked or coupled position, or any other locked position, back into the direction of this initial or other position concerned. Preferably, this restoring force is operative, on the one hand, as soon as the floor panels move away from each other from said initial or other mutual position, and on the other hand, as soon as the floor panels move towards each other from said initial mutual position. Still better, the restoring force increases with increasing distance of the floor panels from said initial or other mutual position.

However, in contrast to the above, according to all aspects of the invention, it is not excluded that the possible restoring force, during the movement of the coupled floor panels from the initial or any other mutual position, either when moving away from each other, or when moving towards each other, at least solely occurs after a certain delay, for example, after a certain play in said positioning means has been overcome. In the case that there is a gap or space between the respective sides in the initial or other coupled mutual position concerned, however, it is recommended to keep said play smaller than said gap, such that the advantages of the present invention can be maintained in any respect.

The present invention in all its aspects may be applied to various kinds of floor panels. Preferably, it is applied for floor panels consisting at least in part of wood or wood-based material, as this kind of floors, as well as the floors comprising a core of natural materials, such as grasses, wood or wood-based material, are strongly subject to shrinkage and/or expansion.

Thus, for example, the invention may be applied for floor panels intended for forming solid parquet, prefabricated parquet, veneer parquet, bamboo flooring, laminate flooring or the like. However, it is not excluded that the invention also is applied with floor panels which are free of wood or wood-based material or other natural material, such as with ceramic or other stone floors, for example, of the type known from WO 03/040491, or with floor panels which comprise a core substantially consisting of synthetic material, for example, with floor panels consisting of compact laminate.

Of course, the floor panels of the present invention according to all aspects also may be provided with coupling means and/or locking means at both pairs of opposite sides, wherein then preferably positioning means or positioning portions are applied at both pairs, too.

Finally, the invention also relates to a ninth independent aspect, the characteristics of which will become evident from the detailed description.

BRIEF DESCRIPTION OF THE DRAWINGS

With the intention of better showing the characteristics of the invention, hereafter, as an example without any limitative character, some preferred forms of embodiment are described, with reference to the accompanying drawings, wherein.

DETAILED DESCRIPTION OF PREFERRED EMBODIMENTS OF THE INVENTION

Figure 1:
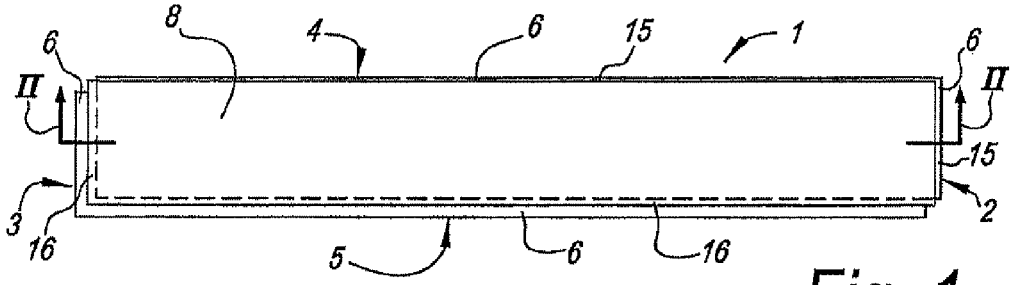
FIG. 1 represents a floor panel with the characteristics of the present invention.

FIG. 1 represents a floor panel 1 of the type, which, at least at two opposite sides 2-3 or 4-5, in this case both at a first pair of opposite sides 2-3 and at a second pair of opposite sides 4-5, has coupling means 6 which preferably, as this is the case here, substantially extend over the entire length of the sides 2-3-4-5 concerned.

The represented floor panel 1 relates to an oblong rectangular floor panel 1 with two pairs of opposite sides 2-3-4-5, namely a first pair of short sides 2-3 and a second pair of long sides 4-5. Of course, it is not excluded that the present invention is applied to floor panels 1 with another shape, such as, for example, to square floor panels.

Figure 2:
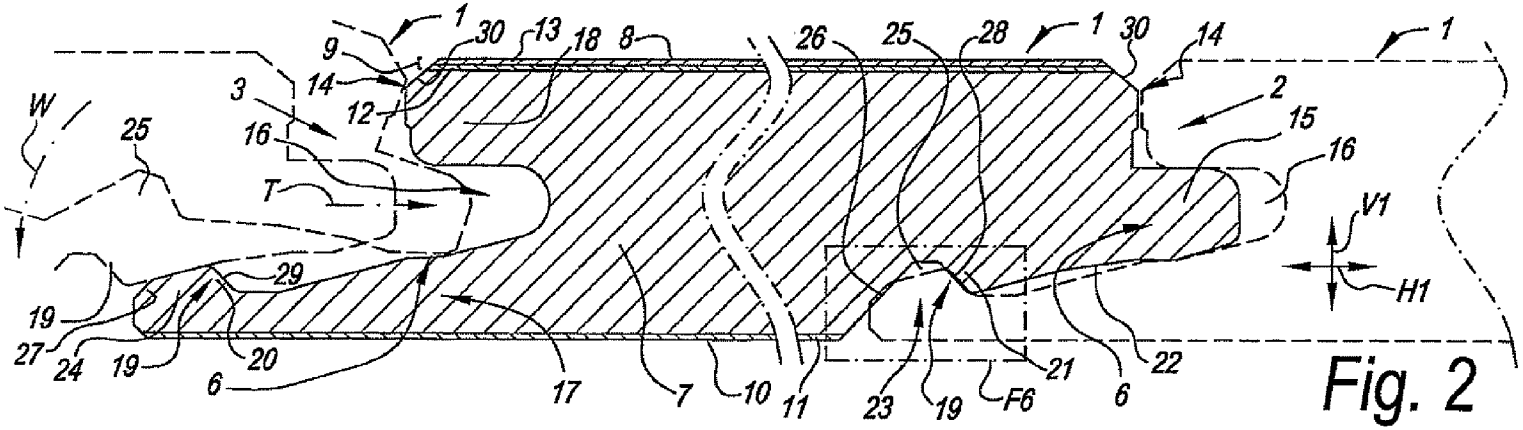
FIG. 2, at a larger scale, represents a cross-section according to the line II-II indicated in FIG. 1.

FIG. 2 clearly shows the construction of the floor panel 1 from FIG. 1. This relates to a floor panel 1 with a core 7 with a layer-shaped top layer 9 situated at the upper side 8. As represented, preferably a sublayer or backing layer 11 is provided at the underside 10 of the floor panel 1. The top layer 9 and/or backing layer 11 may have been effected in various manners. For example, layers of veneer, HPL (High Pressure Laminate), DPL (Direct Pressure Laminate) or a film may be concerned.

The top layer 9 represented in FIG. 2 shows the typical construction of a DPL laminate floor panel 1, wherein this top layer 9 comprises at least a decorative layer 12, which shows a print and comprises a protective layer or overlay 13 with hard particles, such as aluminum oxide or the like. These layers 12-13 preferably comprise a carrier sheet, for example, a paper sheet, which is provided with a synthetic resin, such as melamine. In the case of a DPL, as in the present case, these layers 12-13 are connected to each other and to the core 7 by means of one and the same press treatment. This is contrary to a HPL, wherein first the top layer 9 is separately made by means of a press treatment, after which it is provided on a core 7, for example, by gluing this top layer 9 onto the core 7. The sublayer 11 represented in FIG. 2 also relates to a carrier sheet provided with resin, more particularly a paper sheet, which is connected to the core 7 when forming the DPL top layer 9 in the same press treatment.

As FIG. 2 shows, said coupling means 6, at least at said first pair of opposite sides 2-3, however, preferably at both pairs of opposite sides 2-3-4-5, are made in one piece with the floor panel 1, more particularly in one piece with the side 2-3 and in particular in one piece with the core 7 of the floor panel 1. In the example, this relates to a core 7 of wood-based material, more particularly of finely-ground wood, which is kept together by means of a binding agent, such as MDF or HDF (Medium Density Fiberboard or High Density Fiberboard). Other examples of such materials are various kinds of particle board or OSB (Oriented Strand Board).

By means of the floor panels 1 represented in dashed line at the left hand side of the figure, it is illustrated that the coupling means 6 allow that two of such floor panels 1 may be coupled to each other at the respective sides 2-3 in a manner known as such. This is possible, as illustrated, either by bringing the one floor panel 1 with a substantially horizontal shifting movement T laterally into the other floor panel 1, wherein use is made of a so-called click- or snap-effect, or by turning the one floor panel 1 by means of a relative turning movement W around the respective upper edges 14 into the other, wherein also a click- or snap-effect may occur. However, the invention is not restricted to coupling means 6 allowing for both coupling manners described herein above, however, also relates to floor panels 1 with coupling means allowing at least one of the herein above-mentioned coupling manners, and/or which allow at least one other coupling manner, such as a coupling by means of a substantially downward translation movement, also denominated "push lock", wherein also a click- or snap-effect may occur.

By means of the floor panel 1 represented in dashed line at the right hand side of the figure, it is illustrated that the coupling means 6, in a coupled condition of two of such floor panels 1, provide for a locking in the vertical direction V1 perpendicular to the plane defined by coupled floor panels 1, as well as in horizontal direction H1 perpendicular to the respective sides 2-3 and in the plane of coupled floor panels 1. The locking in vertical direction V1 is obtained by means of a tongue 15 and a groove 16, which during coupling are brought into each other, wherein said groove 16 is bordered by means of a lower lip 17 and upper lip 18. The locking in horizontal direction H1 is obtained by locking means 19 present at the coupling means 6. In this case, the locking means 19 relate to an upward-directed locking element 20 at said lower lip 17 and a locking element 21 cooperating therewith at the underside 22 of said tongue 15. The upper lip 18 of the groove 16 in this case is free of locking means 20 or locking elements.

Figure 3:
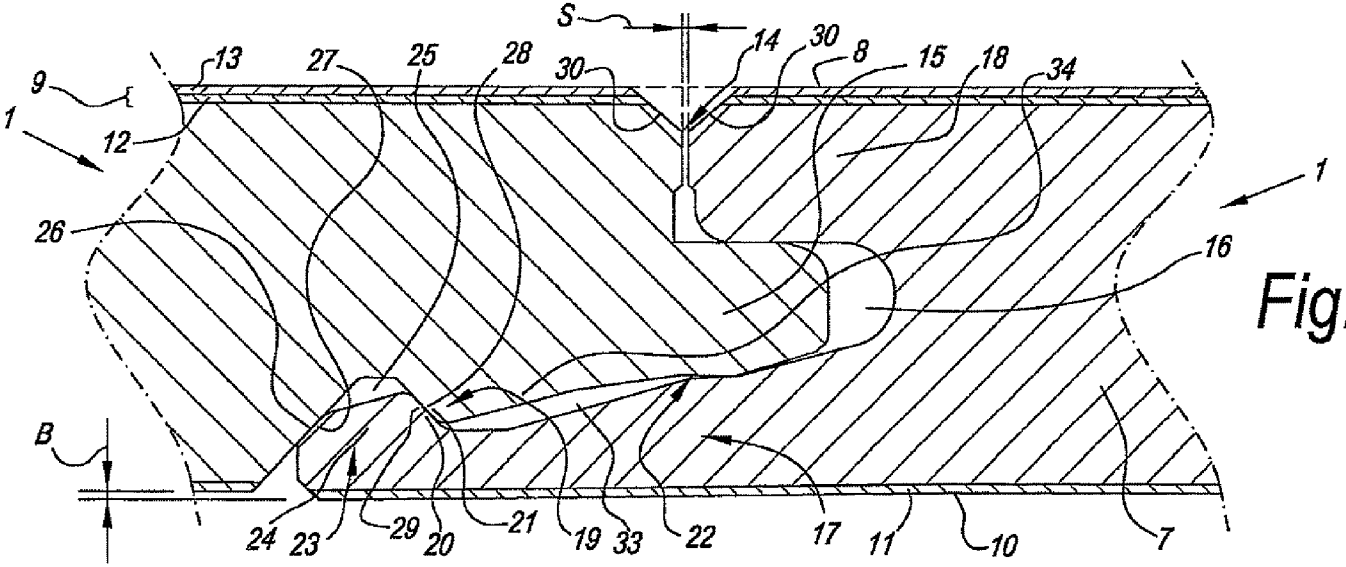
FIG. 3, at a larger scale, represents the initially coupled position of two of the floor panels represented in FIG. 1.

FIG. 3 shows at a larger scale that the floor panels 1 of the FIGS. 1 and 2, during coupling, are brought into an initial locked mutual position, wherein at the height of the upper edges 14 of the coupled floor panels 1, between the respective sides 2-3 or 4-5, a space S is present, in this case a well-defined space S. This space S is obtained by means of the cooperation of positioning means 23 which are provided on said coupling means 6. In this case, the positioning means 23 comprise a positioning portion 24 in the shape of said upward-directed locking element 20 of the lower lip 17 and a positioning portion 25 cooperating therewith at the underside 22 of said tongue 15, which in this case is made as a slot opening towards the underside 10 of the respective floor panel 1.

Figure 4:
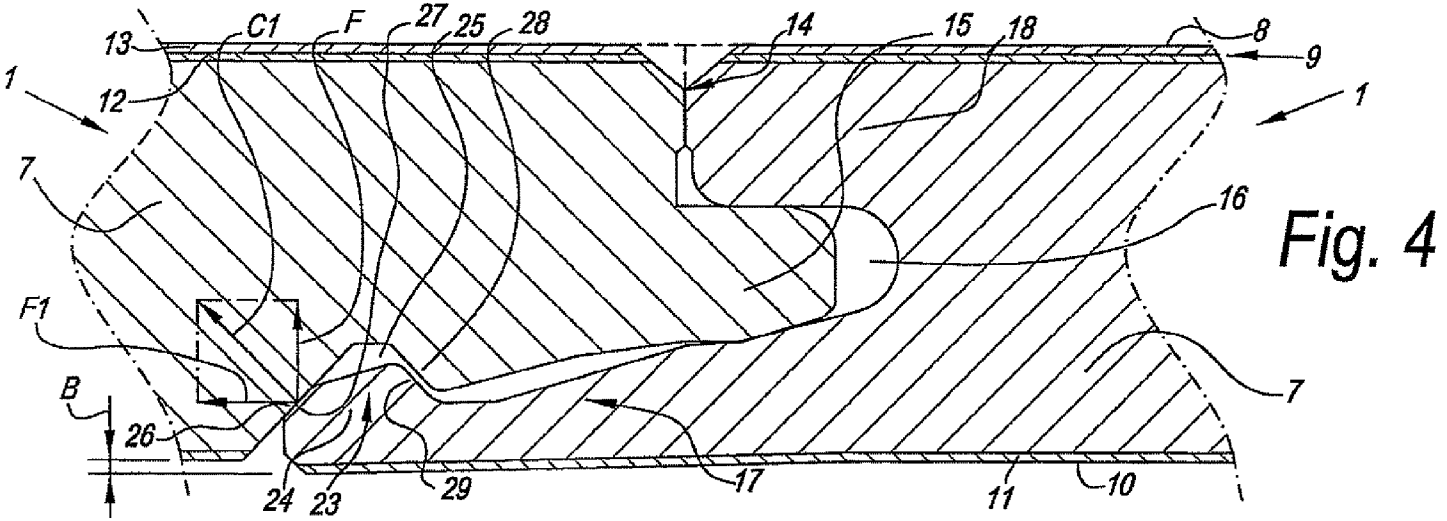
FIGS. 4 and 5, by means of the example from the FIGS. 1 to 3, illustrate the working principle of the present invention.

As FIG. 4 shows, said space S makes it possible that the coupled floor panels 1 may leave the initially coupled position shown here by shifting towards each other in a locked condition in horizontal direction H1. In such movement, the coupling means 6, more particularly the positioning means 23, provide for a restoring force F1 towards the aforementioned initial mutual position. In this case, the restoring force F1 is exerted by means of a first pair of cooperating positioning surfaces 26-27, which are present on said positioning portions 24-25. The actual restoring force F1 concerns the horizontal component of the contact force C1 exerted by the first pair of positioning surfaces 24-25 upon each other.

From FIGS. 3 and 4, it is clear that said lip 17 comprising the positioning portion 24, in other words, in this case the lower lip 17 comprising the upward-directed locking element 20, in the initial mutual position, represented in FIG. 3, is situated in a bent-out position and that this bending B has increased in FIG. 4 as a result of the relative displacement of the floor panels 1 towards each other. Preferably, a portion of this increase concerns an elastic bending of the lower lip 17, such that this bending during a subsequent movement towards each other may take place at least partially again and possibly can contribute to said restoring force F1.

Figure 5:
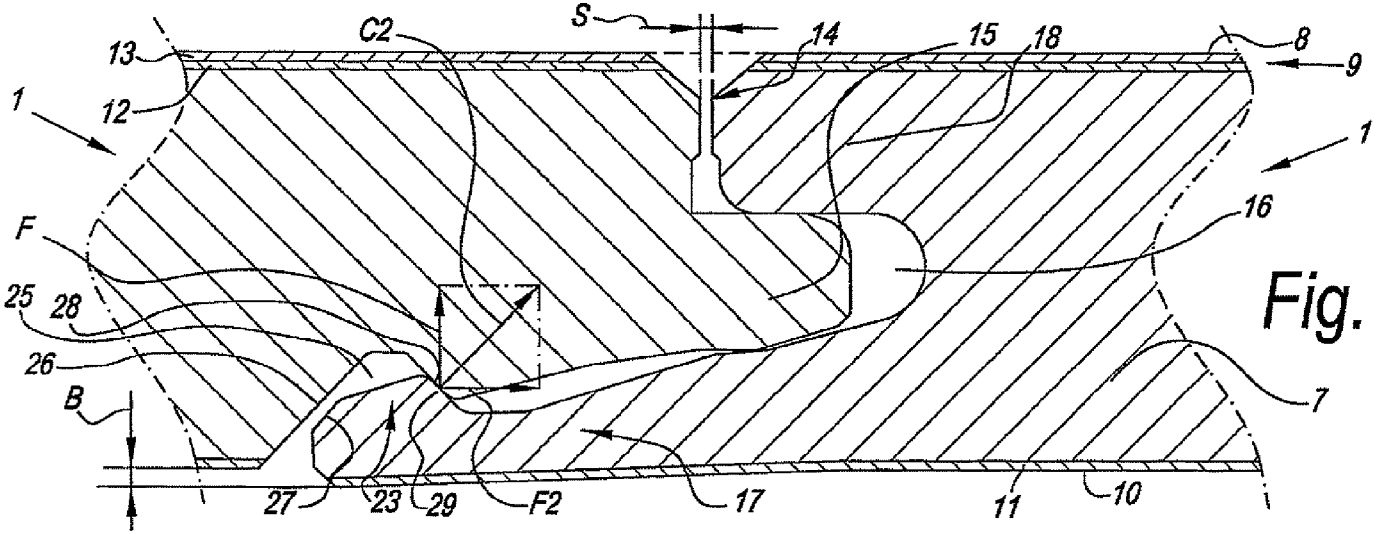

As FIG. 5 shows, the coupling means 6 from previous figures also allow that the coupled floor panels 1 can leave the initial mutual position, represented in FIG. 3, by moving away from each other in a horizontal direction H1. In the example, this is obtained by means of the bendable lower lip 17. In this case, too, the coupling means 6, more particularly the positioning means 23, provide for a restoring force F2 towards said initial mutual position. In this case, the restoring force F2 is exerted by means of a second pair of cooperating positioning surfaces 28-29, which are present on said positioning portions 24-25. The actual restoring force F2 concerns the horizontal component of the contact force C2, which is exerted by the second pair of positioning surfaces 28-29 upon each other. In comparison to FIG. 3, the bending of the lower lip 17 has increased as a result of the relative displacement of the floor panels 1 away from each other. Preferably, a part of this increase relates to an elastic bending of the lower lip 17, such that this bending, during a new movement away from each other, at least partially can take place again and possibly can contribute to said restoring force F2.

Generally, it is noted in connection with the invention that the positioning means 23 or portions 24-25 preferably are at least present on said lower lip 17, and that still better said upper lip 18 is free of such positioning means or portions. However, according to all aspects of the invention it is not excluded that such positioning means or positioning portions are also present at the upper lip 18 and/or that the lower lip 17 is free of such positioning means or portions.

In respect to FIGS. 4 and 5, it is noted that it is not excluded that the restoring force F1-F2 also may exist without having a bending B or increased bending of a lip 17-18. In such case, for example, one may recur to the local deformation of positioning means 23, such as, for example, to the compression of a positioning means that is elastic to a certain extent, to the bending of a positioning means, or solely to a contact between the positioning portions.

The floor panels 1 represented in the FIGS. 2 through 5 are provided with chamfers 30, more particularly bevels, at the upper surface or upper side 8 along the respective sides 2-3. Such chamfers 30 at the upper edges 14 may hide the gap S possibly present in the initial mutual position entirely or partially from the view of the user. However, it is clear that according to the invention, such chamfers 30 do not necessarily have to be applied. As indicated in dashed line in FIGS. 3 to 5, straight upper edges may also be applied.

In order to keep the floor covering esthetically attractive for the user and/or in order to avoid that too much dust penetrates into the connection, such gap or space S according to a first possibility in the initial mutual position or in any other position preferably shall be kept smaller than 0.5 millimeters, and preferably smaller than 0.2 millimeters, such as, for example, a gap S with a dimension between 0.05 and 0.15 millimeters.

According to a second possibility, special effects can be achieved with larger gaps or spaces S than this is the case in said first possibility. According to this second possibility, the gap or space S defines a distance between the upper edge 14 of opposite sides 2-3 which is larger than one millimeter, and preferably is smaller than three millimeters. This second possibility can be applied in all aspects of the invention. In particular, this possibility is applicable in the fourth and/or the fifth aspect of the invention.

In a preferred form of embodiment of all aspects of the invention and according to said first possibility, the floor covering fulfills the standard valid for the respective type of floor covering; so, for instance, a floor covering of the type laminate flooring preferably meets the standard EN 13329, and in particular the inventors, in respect to said preferred form of embodiment, consider the test methods as described in annex B of that standard as applicable. However, in the most preferred form of embodiment of the present invention according to all of its aspects a better result is obtained than the standard does prescribe, at least in respect to gaps in the top surface of the floor.

It is clear that according to the above first possibility as well as according to the above second possibility, the respective space S between the upper edges 14 can be filled-up entirely or partially, for example, with a substance or with a strip, such that the space possibly is no longer present in the floor covering as an effective gap, however, that the substance or strip provided therein fulfills a decorative or other function. However, the application of such substance or strip clearly is not necessary for the present invention. According to their dimensions, such effective gaps may show, offer, respectively, certain decorative and/or functional features or effects.

Figure 6:
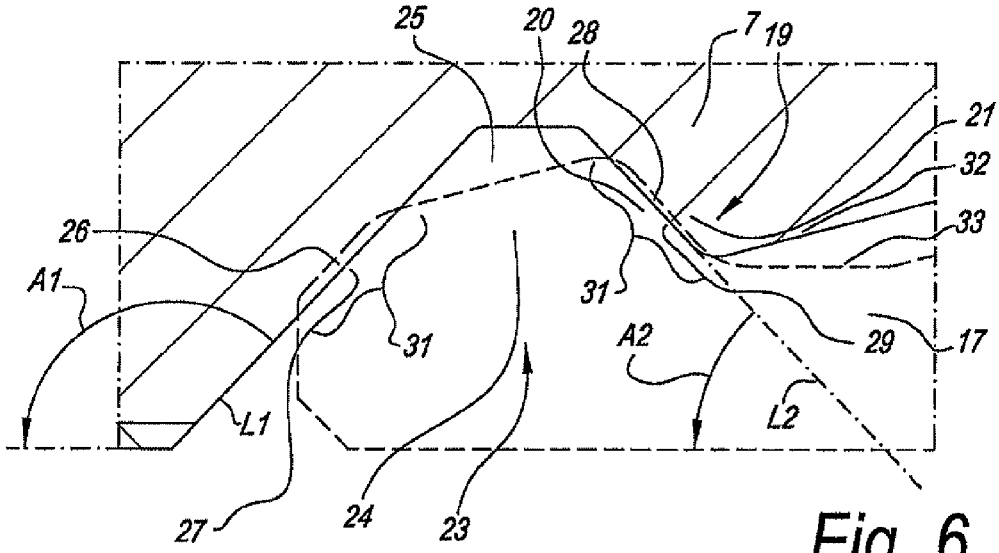
FIGS. 6 to 8, at a larger scale and for different variants of the invention, represent a view onto the area indicated by F6 in FIG. 2.

FIG. 6 shows that in the example of the FIGS. 1 through 5, the geometry of the cooperating positioning portions 24-25, preferably at least at the height of said positioning surface 26-27-28-29, can be made overlapping. In this manner it can be obtained that said first pair 26-27 and second pair 28-29 of mutually cooperating positioning surfaces in the initial mutual position are directly adjoining each other and that the lower lip 17 in the initial locked position is bent out. Another effect, which, amongst others, may be obtained with such geometry, is that said restoring force F1-F2 is operative, respectively, on the one hand, as soon as the floor panels 1 move away from each other from said initial mutual position, and, on the other hand, as soon as the floor panels 1 move towards each other from said initial mutual position.

Figure 7:
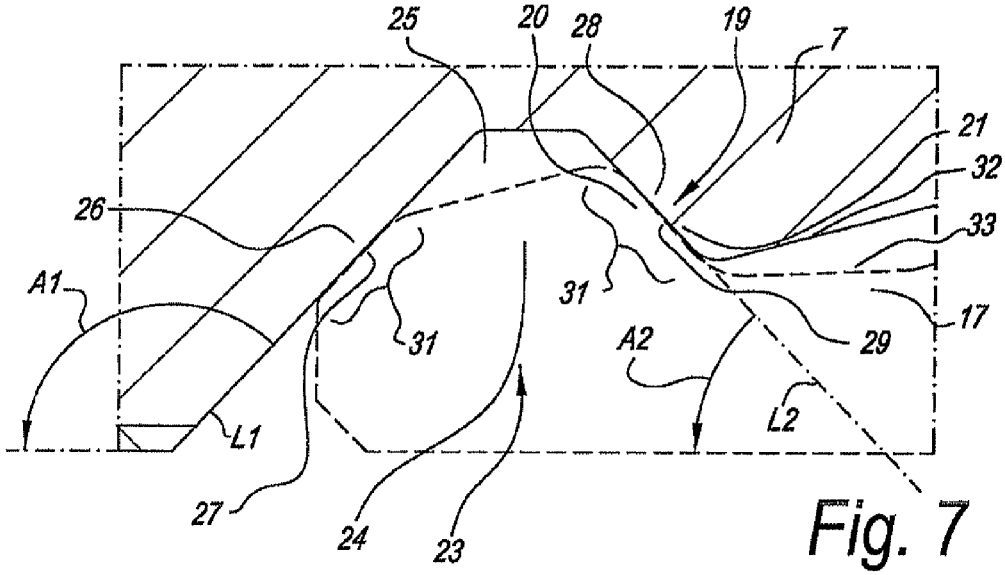

FIG. 7 shows a geometry without overlap, wherein in the initial mutual position, said first pair 26-27 and second pair 28-29 of mutually cooperating positioning surfaces also adjoin each other directly, however, without said lip 17 bending in this position. In this geometry, too, said restoring force F1-F2 shall be operative as soon as the floor panels 1 move from said initial mutual position, either towards each other or away from each other.

Figure 8:
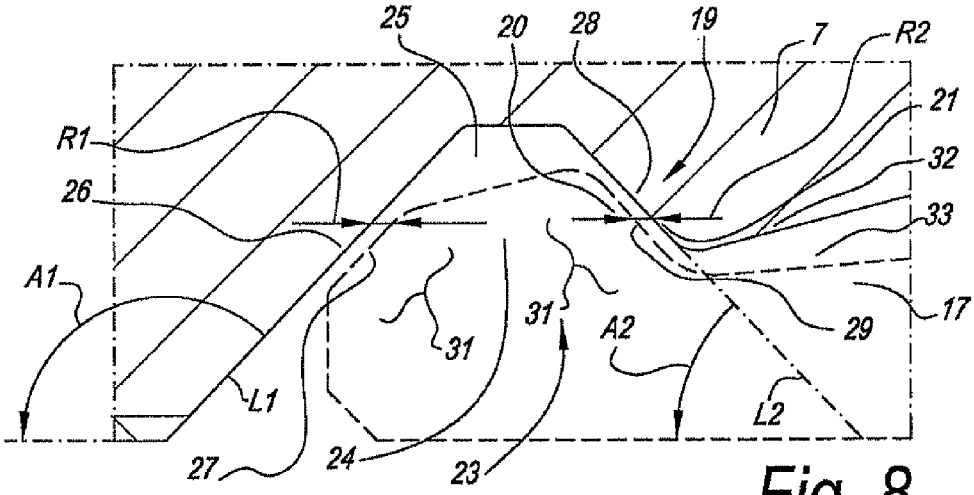

FIG. 8 shows a situation wherein the geometry is such that in a cooperation of said positioning portions 24-25 in the initially coupled position a space is present between at least one of both, in this case between both pairs of positioning surfaces 26-27 and/or 28-29 with the respective size R1, R2. In the example, these distances R1-R2 between the pairs of positioning surfaces result in a play in the cooperating positioning portions 24-25, which preferably is kept smaller than the possible space S in the initial mutual locked position. In the represented example, the size of the play corresponds to the sum of the distances R1 and R2.

In respect to FIGS. 6, 7 and 8 is noted that said pairs of positioning surfaces 26-27-28-29 preferably, as it is the case here, show a sloping portion 31, which, still better, extends in a flat manner. The tangent lines L1-L2 at said sloping portions 31 of the first and second pairs of positioning surfaces 26-27-28-29 in anti-clockwise sense preferably enclose an angle A1, A2, respectively, with the underside 10 of the floor panel 1 of more than, less than, respectively, 90°. The sum of the angles A1 and A2 either may be larger than, smaller than, or as well equal to 180°, moreover the angle A1 may be larger than, smaller than or equal to the supplement of A2. For clearness' sake, it is noted that the supplement of A2 is equal to 180° minus A2. Further, it is noted that in the present examples, there exists or is created a flat contact between the positioning surfaces 26-27-28-29 of one and the same pair. However, according to the invention, it is not excluded that a line contact is created, for example, in that at least one of the positioning surfaces 26-27-28-29 of one and the same pair shows a curvature. In such case, the angles A1 and A2 are to be determined by means of the tangent lines L1-L2 in the contact point in the mutual positions of the floor panels 1, which are as close to the initial mutual position as possible.

Figure 9:
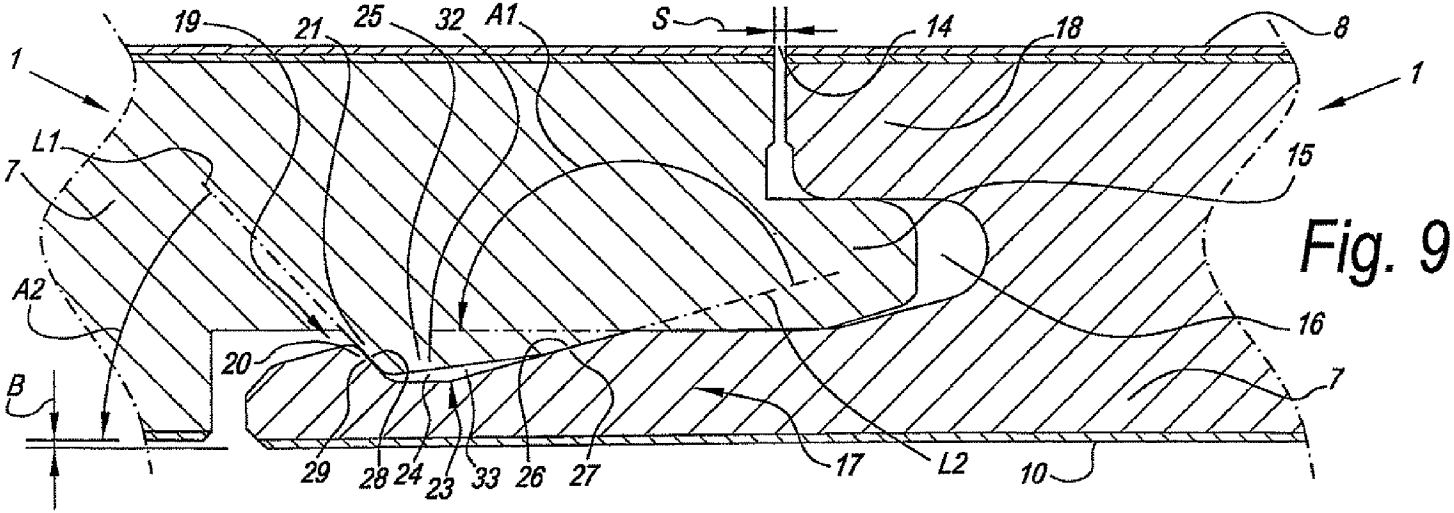
FIGS. 9 to 11 represent views similar to those of FIGS. 3 to 5, however, for a variant.
Figure 10:
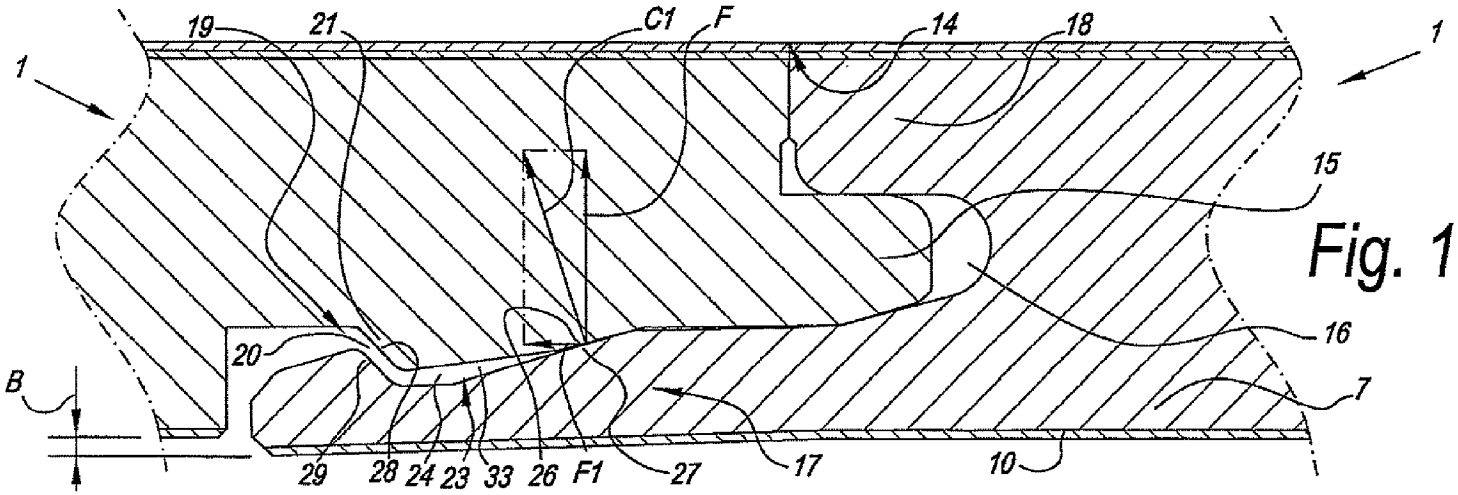
Figure 11:
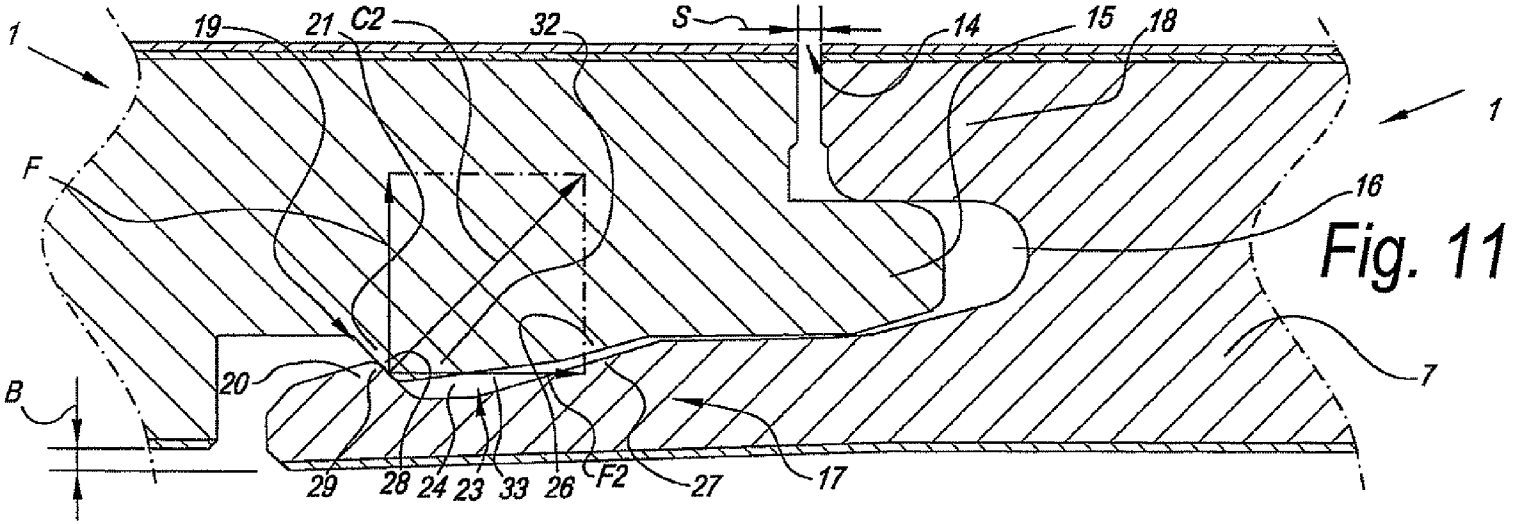

FIG. 9 shows another form of embodiment of the present invention in the initially coupled mutual position. The particularity of this form of embodiment is that said positioning portions 24-25 comprise at least a recess 32 at the underside 22 of the tongue 15 and a recess 33 in the lower lip 17. Moreover, the sum of the angles A1 and A2, which are formed by the sloping portions 31 of the first 26-27 and second pair 28-29 of positioning surfaces with the underside 10 of the floor panel 1, clearly are larger than 180°. In the example, the angles A1-A2 are chosen such that a stronger horizontal contact is formed between the second pair 28-29 of positioning surfaces than between the first pair 26-27 of positioning surfaces, which may lead to a stronger restoring force F2, when the floor panels want to move apart from each other, out of the initial mutual position, than the restoring force F1 when they want to move towards each other from this initial mutual position.

Analogous to FIGS. 4 and 5, FIGS. 10 and 11 illustrate the working principle of the embodiment of FIG. 9. In respect to the bending B of the lower lip 17, identical remarks can be made as in respect to FIGS. 3 to 5.

Figure 12:
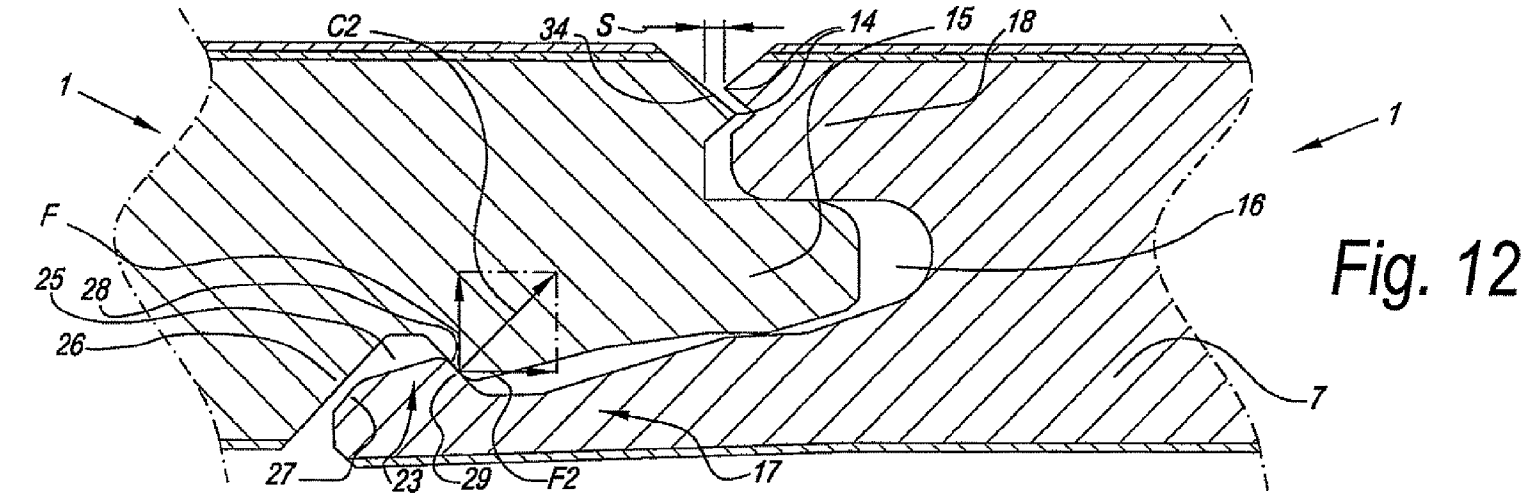

FIG. 12 shows a variant of the floor panel 1 of the preceding figures, wherein the upper edges 14 of the coupled floor panels 1 are situated above each other, or in other words, overlap, at least in the initially coupled position. Such overlaps of the upper edges 14 are known as such, for example, from WO 2005/068747, however, in combination with the present invention in al its aspects offer particular advantages. However, the kind of overlap of the upper edges 14 shown in FIG. 12 is not known from the state of the art and relates to another particular aspect of the present invention, independent of the fact whether it is applied in combination with preceding aspects. Herein, this relates to an overlap wherein an inclined portion 34 at the upper edge 14 of the one floor panel 1 is situated beneath the other floor panel 1. Further, it is also noted that the position shown in FIG. 12 is not the initially coupled position, but relates to a position in which the floor panels 1 already have been moved away from each other from the initial mutual position.

Figure 13:
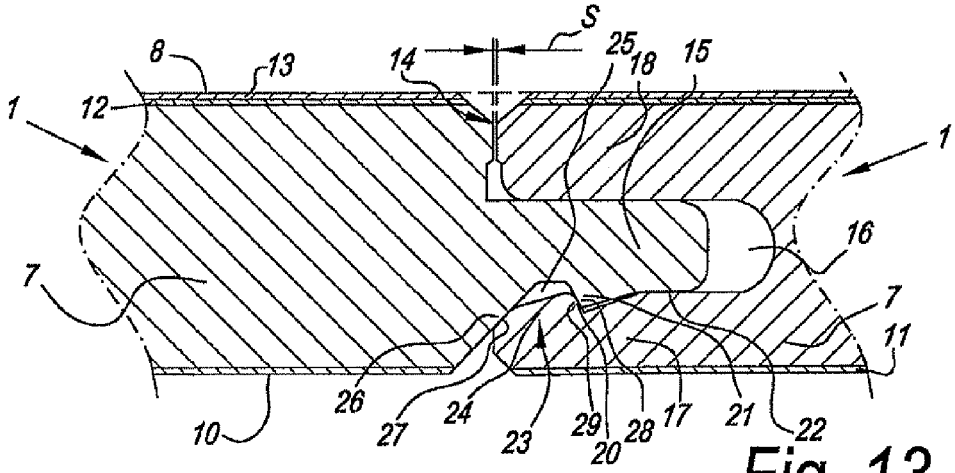
FIGS. 12 to 19 represent still further variants of the present invention.

FIG. 13 shows another possible embodiment of the present invention, which, identical to all preceding figures, shows the characteristics of the first, the second as well as the third aspect. Whereas in the preceding figures, the lower lip 17 extends to beyond the upper lip 18, these lips 17-18 in FIG. 13 are made equally long. However, nothing prevents that the lower lip 17 possibly may be made shorter than the upper lip 18. Also, it is to be noted that, although the restoring force F1-F2, if it has been obtained at least partially by the flexibility of the lower lip 17, with the same displacement from the initially coupled position, may be larger in the embodiment of FIG. 13 than in the preceding embodiments. Of course, this may be advantageous when it is desirable to avoid excessively large gaps at the surface of the floor covering.

Figure 14:
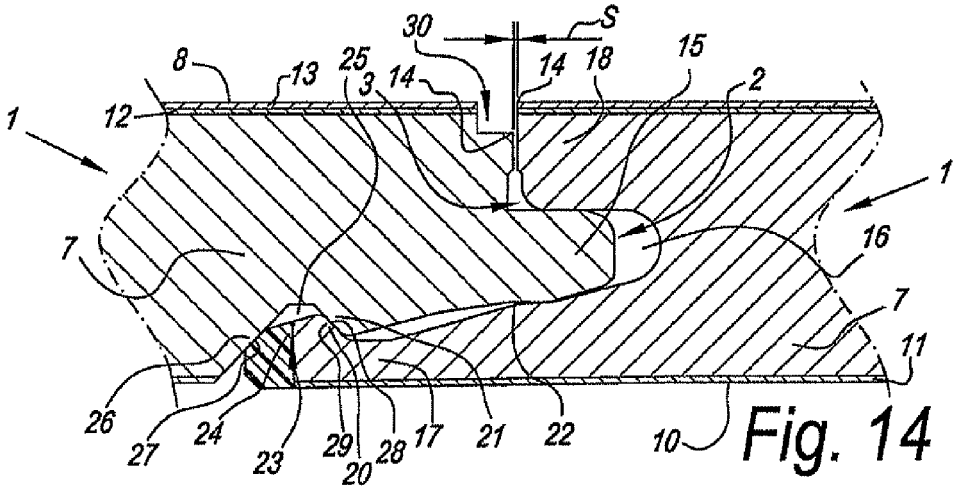

FIG. 14 shows a variant with the characteristics of, amongst others, the second and the third aspect of the present invention, which moreover also shows two particular characteristics, which, of course, may be applied independently from each other.

A first particular characteristic, which, amongst others, may also be applied in the first aspect, relates to the implementation of a chamfer 30 at solely one side 2 of a pair of opposite sides 2-3. In this case, the chamfer 30 has been applied at the tongue side 2.

A second particular characteristic relates to the application of a material differing from the core 7 for forming at least a portion of one of the positioning portions 24-25, in this case a positioning surface 27 of the first pair 26-27. In this case, for the positioning surface 27 of the first pair 26-27, said surface 27 being situated at the groove side 3, an elastic material has been applied which, in the initially coupled position, possibly is compressed to a certain extent, such that, in comparison with the preceding embodiments, it is possible to longer maintain contact between said first pair of positioning surfaces 26-27 when two coupled floor panels 1 move away from each other out of their initially coupled position.

In respect to FIG. 14, it is further noted that both positioning surfaces 28-29 of said second pair are made in one piece with the floor panel 1, in this case even in one piece with the core 7 of the floor panel 1. The fact that at the groove side 3 and/or at the tongue side 2 at least one positioning surface of the one pair, preferably of the second pair 28-29, is made in one piece, whereas at least one positioning surface of the other pair, preferably the first pair 26-27, is made of a more elastic material than said positioning surface made in one piece, may offer particular advantages, for example, in respect to the unambiguousness of the initially locked mutual position of the respective floor panels. In the case that, as is depicted here, both positioning surfaces of the second pair 28-29 are made in one piece with the respective floor panel 1, the compressibility or the elastic deformation of said elastic material, which is present in the first pair of positioning surfaces 26-27, can be applied for positioning the positioning surfaces 28-29 of the second pair, which are made in one piece, against each other. As the positioning surfaces 28-29, which are made in one piece, can be finished more precisely, these positioning surfaces 28-29 may determine the initial mutual position and the possible space S in this initial position in an unambiguous manner.

Figure 15:
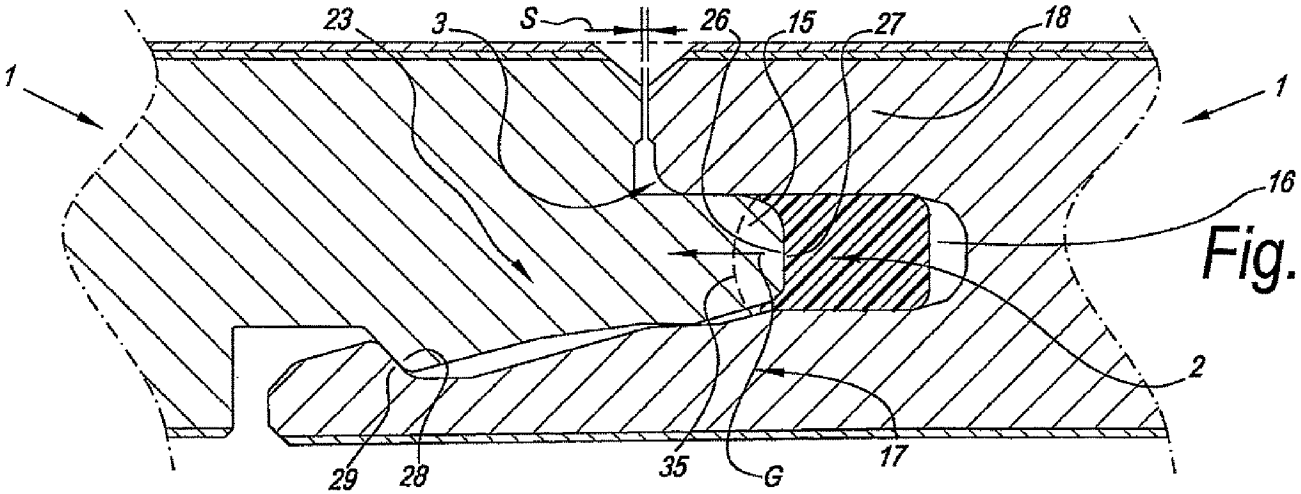

FIG. 15 represents another important embodiment of the invention, which also shows the above-mentioned second particular characteristic. Here, too, at least one positioning surface 27 of the first pair 26-27 is made in an elastic material differing from the core 7. The respective elastic matter is provided separately at the groove side 3 of the floor panel 1 between said lower and upper lips 17-18 of the groove 16, or, in other words, in the groove 16. Here, too, the elastic material, at least in the depicted initial mutual position, has an impression. In dashed line 35, the original shape of the elastic material is represented. Due to its resiliency force, the deformed elastic matter exerts a force G onto the tongue panel, as a result of which said second pair of positioning surfaces 28-29, which in this case is made in one piece with the floor panel 1, comes into contact at least in the initial mutual position.

Figure 16:
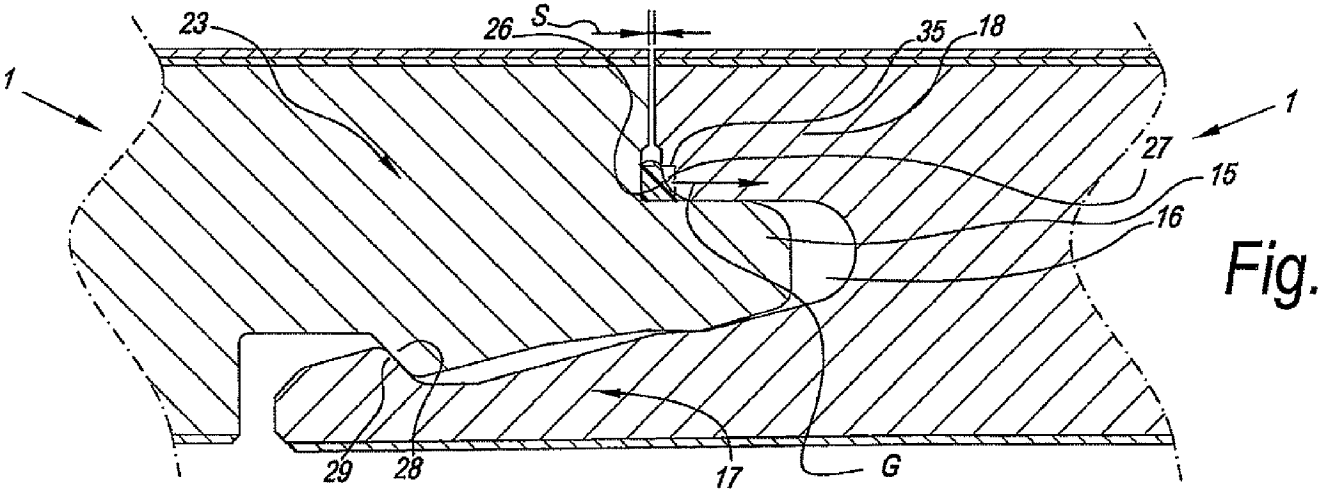

FIG. 16 shows another variant of the floor panel 1 from FIG. 15, however, the elastic matter now is situated at the height of the distal extremity of the upper lip 18. In this embodiment, said elastic matter can be applied at the tongue side 2 as well as at the groove side 3. In the example, the elastic matter is applied separately at the tongue side 2. Here, too, this matter in the initial coupled position shows a deformation, which, by means of a resiliency force, exerts a force G, in this case onto the groove panel, as a result of which said second pair of positioning surfaces 28-29 comes into contact at least in the initial mutual position.

It is clear that according to the invention also multiple positioning portions 24-25 or positioning surfaces 26-27-28-29 may be made at least partially of another, preferably elastic material.

Figure 17:
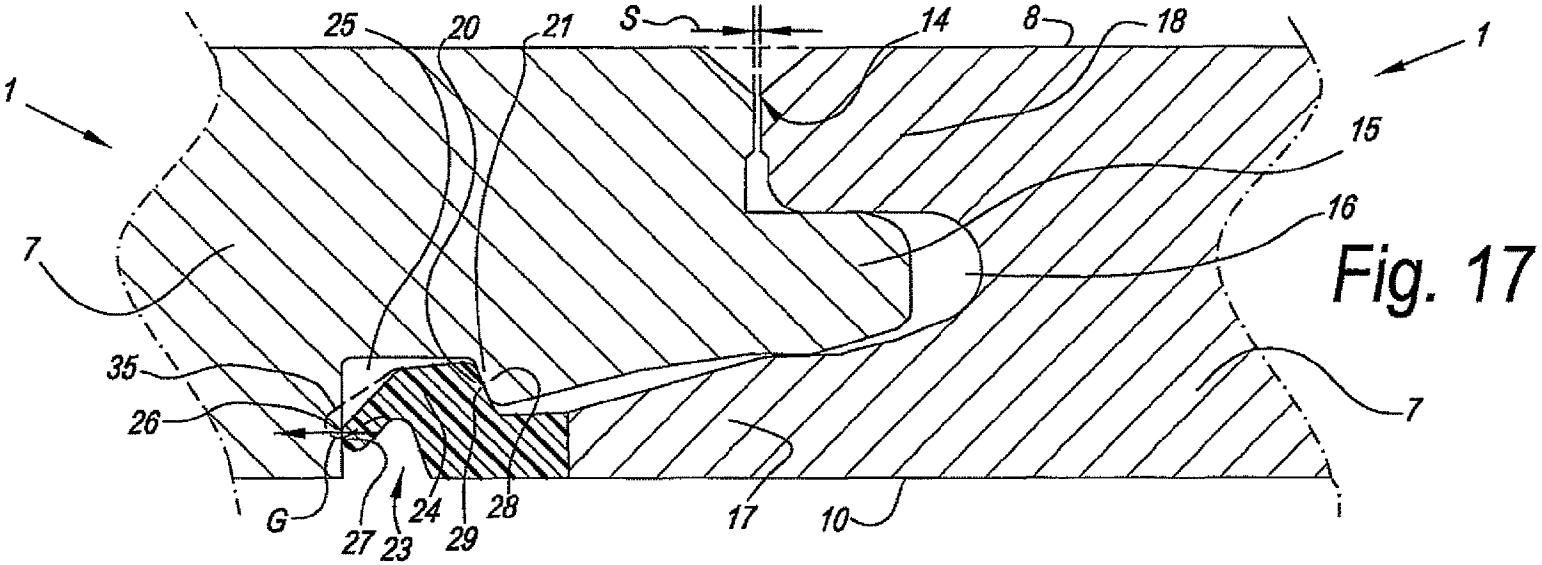

In the embodiment of FIG. 17, the locking element 20, which is situated on or at said lower lip 17, as a whole is made of an elastic material, such that of each pair of positioning surfaces 26-27-28-29 each time at least one is made of an elastic material. In this manner, an easy coupling of the floor panels 1 can be obtained. In the example, the design of the locking element 20 is such that the restoring force F2 is larger with a movement away from each other than the restoring force F1 when the floor panels 1 are moving towards each other. This is due to the fact that the distal extremity of the lower lip 17, on which a positioning surface 27 of the first pair 26-27 is formed, is made movable. In the initial mutual position, as represented with dashed line 35, the elastic matter of the locking element 20 rather is bent than compressed. It is noted that such floor panels 1, for example, may be manufactured in a beneficial manner by means of synthetic material extrusion, wherein then said locking element 20 is co-extruded from a more elastic material than the material of the floor panel and/or the core 7. Of course, it is not excluded that the embodiment of FIG. 17 is manufactured of other materials than synthetic material.

Figure 18:
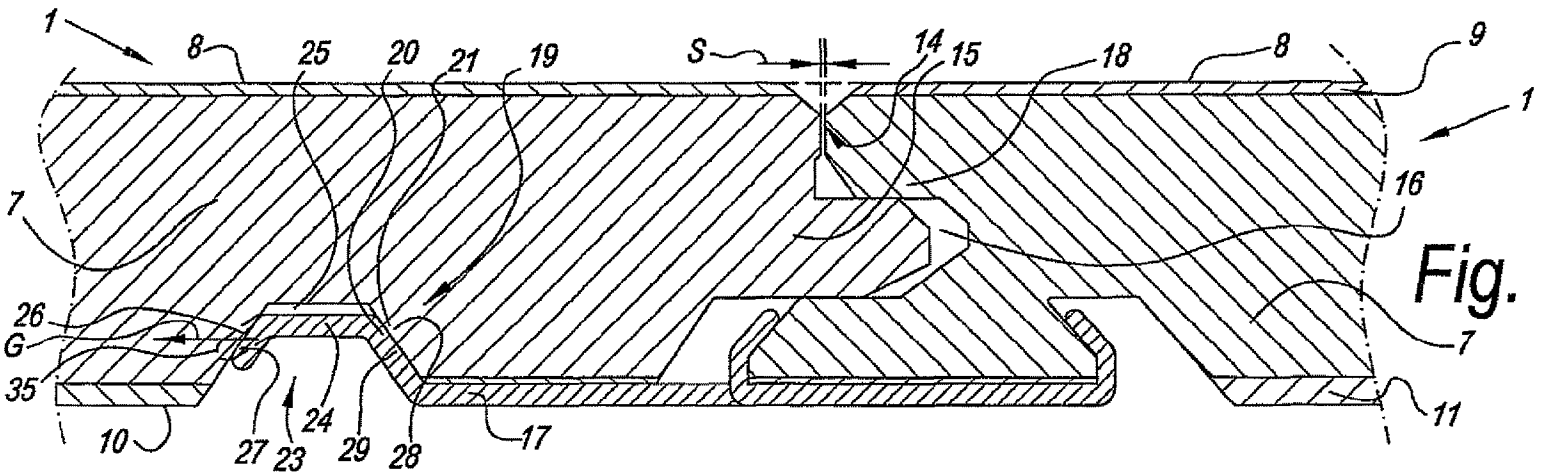

FIG. 18 shows another such example, wherein the entire lower lip 17, the positioning portion 24, in this case, the upward-directed locking element 20, inclusive, is made of another material, for example, aluminum or spring steel.

It is noted that the elastic material mentioned in connection with FIGS. 14 to 17 may consist, for example, of soft rubber or another material with a certain mechanical strength and elasticity.

According to a not represented variant, the space S which in the above-mentioned preferred embodiments is present at the upper edge, between the respective coupled sides, in the initial locked mutual position, can be filled up by means of a, for example, elastic material, such that globally seen the same functioning of the entire coupling is maintained. Possibly, for filling up said space, also a material may be applied without considerable mechanical strength, such that this material has only a negligible influence onto said restoring force.

In relation to the above-described chamfers 30 and bevels, it is also noted that those, in manners known as such, may be provided with a separate decorative layer. Possibly, such decorative layer may also be applied below the upper edge 14, below the chamfer 30, bevel or inclined portion 34. For various applicable techniques, reference is made to the state of the art, for example, WO 01/96688 or WO 2006/063803, wherein this latter then specifically relates to the coloring of upright walls.

From the above, it is clear that it is not excluded that the characteristics of the first, the second and/or the third aspect mutually are combined and that in this manner various synergetic effects are obtained, which may solve the problems of the state of the art discussed in the introduction in an even better manner or which may meet the desires discussed there. From the following, it will also become clear that the other aspects of the present invention may be mutually combined, as well as possibly combined with the first, second and/or third aspect of the invention.

Referring to FIGS. 9 to 11 and 14 to 17, it is also noted that they form an example of a ninth independent aspect of the invention, wherein this aspect then relates to a floor panel having, at least at two opposite sides 2-3, coupling means 6 which can cooperate with each other, which substantially are made in the form of a tongue 15 and a groove 16, the latter being bordered by means of a lower lip 17 and an upper lip 18, and which, in a coupled condition of two of such floor panels 1, provide for a locking in a vertical direction V1 perpendicular to the plane defined by the coupled floor panels 1, wherein said coupling means 6 also comprise locking means 19, which, in a coupled condition of two of such floor panels 1, provide for a locking in a horizontal direction H1 perpendicular to the respective sides 2-3 and in the plane of the coupled floor panels 1, with as a characteristic that the floor panel 1 at the respective opposite sides 2-3 also comprises positioning portions 24-25, which cooperate such that, when coupling two of such floor panels 1, an initial locked mutual position is created, wherein the coupled floor panels 1 can leave said initial mutual position by shifting in a locked condition in horizontal direction H1 towards each other as well as shifting away from each other; that, when the coupled floor panels 1 leave said initial mutual position, with a movement towards each other as well as with a movement away from each other, there is a restoring force F1-F2 towards said initial position; and that said restoring force F2, with a displacement of the floor panels 1 from the initial mutual position away from each other, is larger than with an equally large displacement of the floor panels 1 from the initial mutual position towards each other. From the figures and the description, amongst others, in respect to the sloping portions 31 of said positioning surfaces 26-27-28-29, it is clear that such floor panels 1 can be made in various manners.

Figure 19:
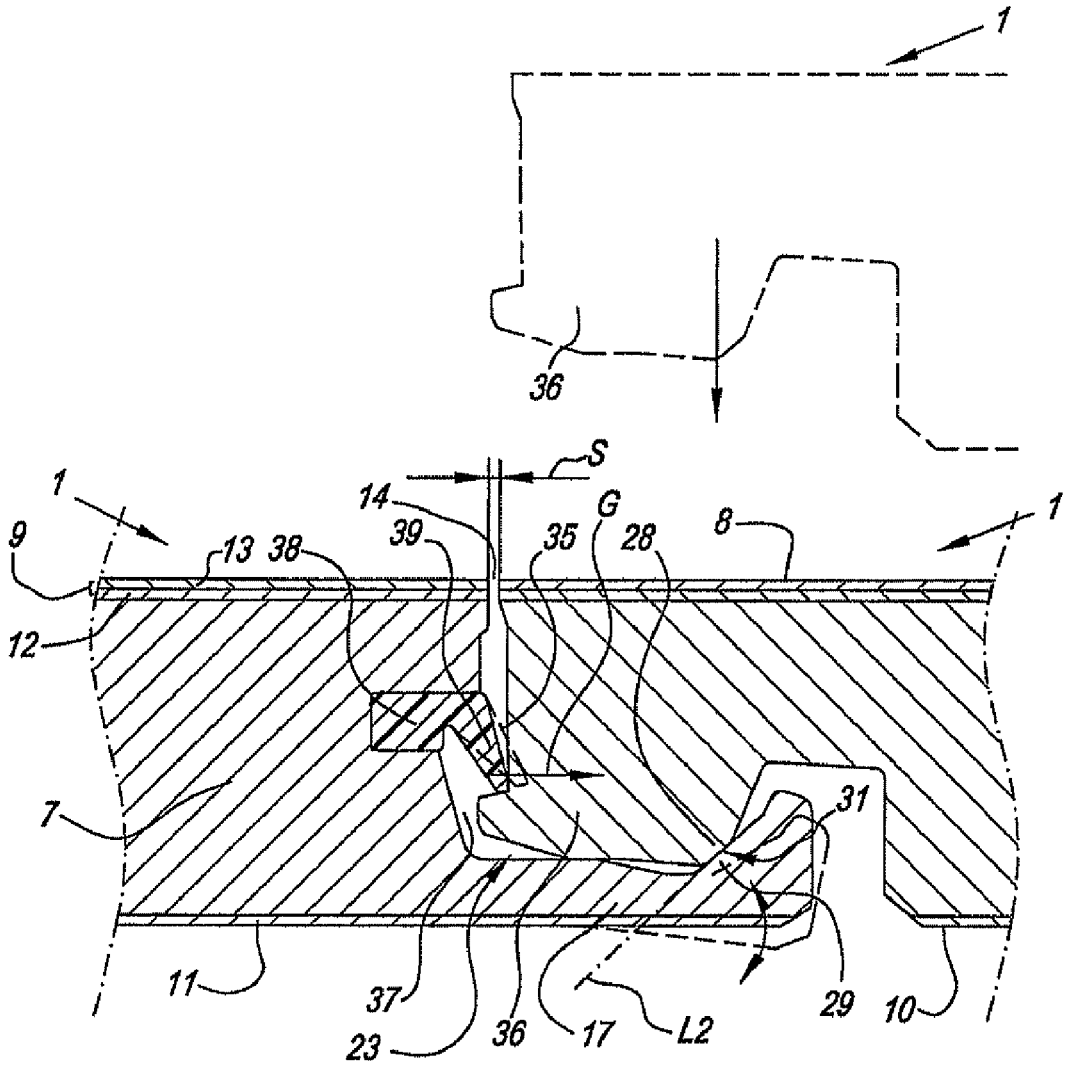

FIG. 19 shows another embodiment, wherein the invention is applied in a so-called "push-lock" coupling. Herein, this coupling is implemented according to said particular variant of the first aspect, according to which the coupling means are made only substantially in one piece with the floor panel, in other words, not entirely in one piece, and wherein the positioning means are at least partially made of a separate material. In this case, the coupling means substantially consist of a mutually cooperating male part 36 and female part 37. The positioning means 23 are formed by, on the one hand, inclined positioning surfaces 28-29, and, on the other hand, an integrated element 38 of another material with an elastically bendable locking and positioning lip 39. The lip 39 is designed such that the floor panels in initial coupled condition are pressed with their positioning surfaces against each other and a condition of equilibrium is obtained, wherein a space S is present between the floor panels. Due to the resiliency of the lip 39, as well as to the resiliency of the lip 17 situated beneath, it is obtained that, with shrinkage, expansion, respectively, of the floor panels, a mutual movement among these floor panels is possible.

Figure 20:
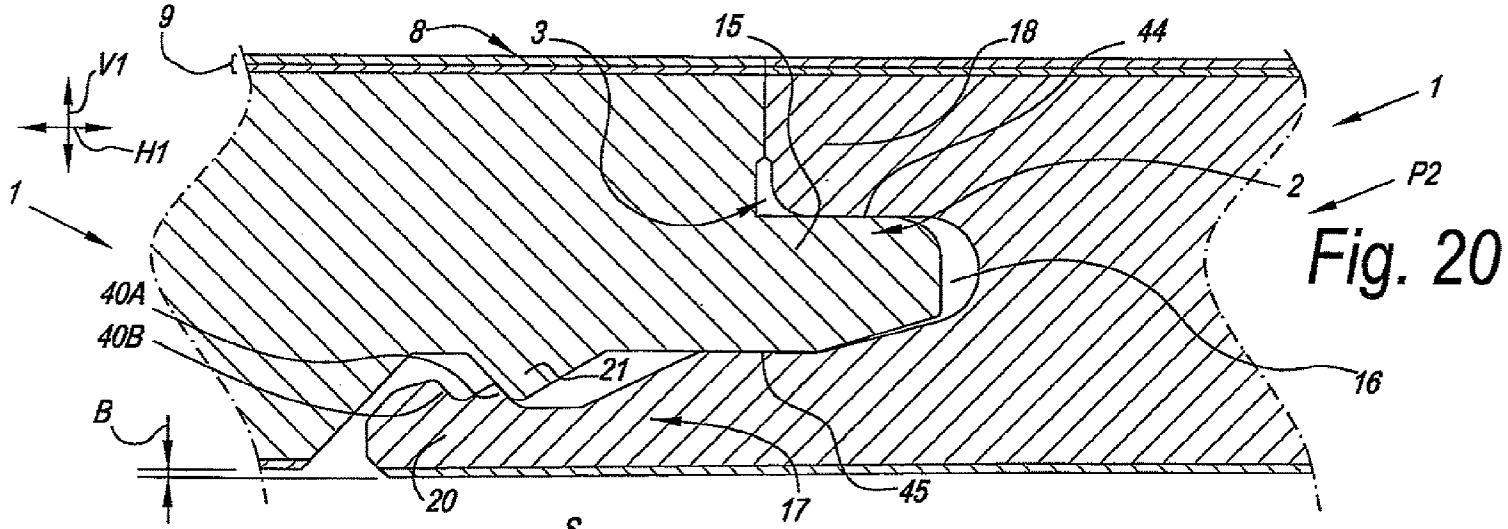
FIGS. 20 to 23 in cross-section show several examples of floor panels having, amongst others, the characteristics of the seventh aspect of the invention.

FIG. 20 represents an example of coupling means 6 which, amongst others, can be used at least at two opposite sides 2-3 with floor panels 1 with the characteristics of said seventh aspect of the invention.

Figure 21:
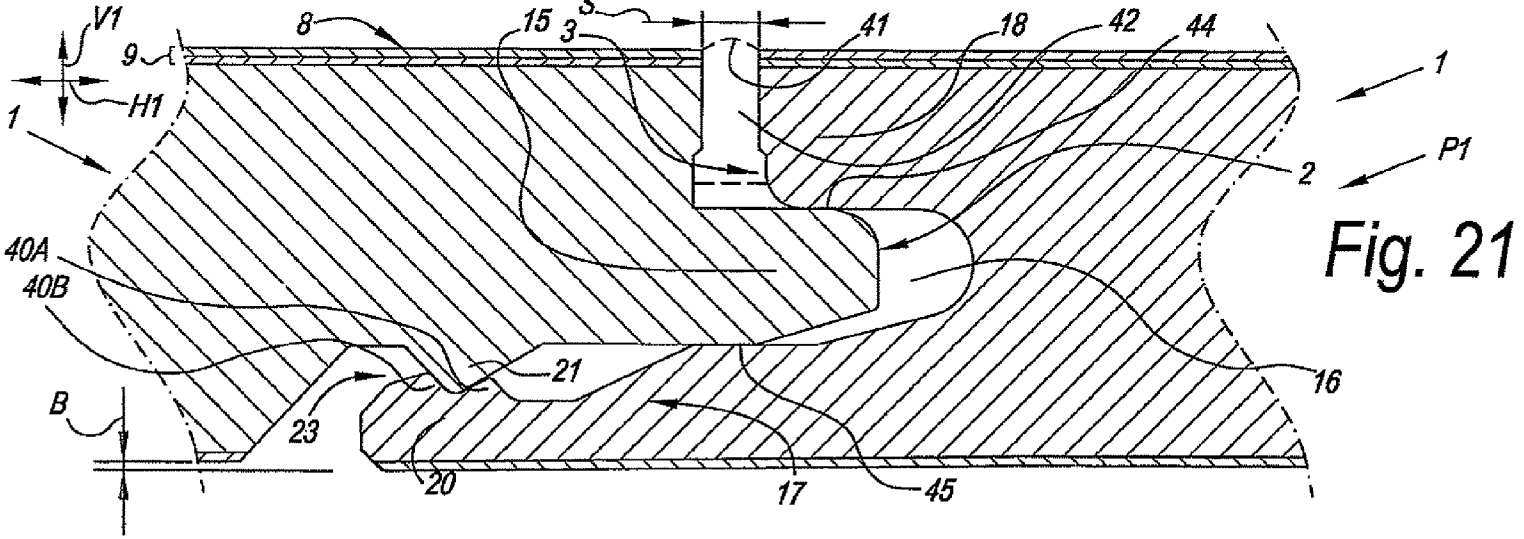

The represented coupling means 6 substantially are constructed as a tongue 15 and a groove 16, the latter being bordered by means of a lower lip 17 and an upper lip 18. The coupling means 6 also comprise locking means 20-21, which in the example are made in the form of a locking element 20 on the lower lip 17 and a cooperating-therewith locking element 21, which is present on the tongue 15, in this case, on the underside 22 of the tongue 15. Said locking element 20 on the lower lip 17 in this case is made with several locking portions 40A-40B, with which it can cooperate with said locking element 21 on the underside 22 of tongue 15. Due to the presence of these locking portions 40A-40B, the coupling means 6 allow for that the floor panels 1 can adopt at least two different mutual locked positions P1-P2. These two possible locking manners P1-P2 are represented in FIGS. 20 and 21. In these two mutual positions P1-P2, each time a locking is obtained both in a vertical direction (V1) and in a horizontal direction (H1).

FIG. 21 represents said first mutual position P1. In this position, a space S is present between the respective coupled sides 2-3, which, as represented in dashed line 41, possibly may be filled-up with a substance or strip 42. This strip 42 possibly may have a decorative function at the upper surface or upper side 8 of the floor covering and may be applied, for example, for imitating a so-called ship's deck. For examples of such strips and ship's deck floorings in general, reference is made to the international patent application PCT/IB2006/003808, also filed by the present applicant.

FIG. 20 represents said second mutual position P2. In this position P2, in this case, there is no or only an almost invisible space S between the respective coupled sides 2-3.

The coupling means 6 also comprise positioning means 23, which prevent that the coupled floor panels 1 leave the respective mutual position, either the first mutual position P1 or the second mutual position P2, in which they are situated, by shifting in a locked condition in horizontal direction H1 towards each other or away from each other. In said first mutual position P1, represented in FIG. 21, the positioning means 23 are formed by both aforementioned locking portions 40A-40B and the locking element 21 on the underside 22 of the tongue 15. When the floor panels 1 want to leave this first mutual position P1, either by shifting away from each other, or by shifting towards each other, each time a restoring force is created, in the meaning of, for example, the first, the second and the third aspect of the invention. In said second mutual position P2, represented in FIG. 20, the positioning means 23 are formed by the locking portion 40A, which is situated proximally in respect to the respective floor panel 1, the locking element 21 on the tongue 15 and the upper edges 14 of the floor panels 1.

It is clear that according to the present invention, it is possible that said first and/or second mutual position P1-P2 relates to a zone in which the mutual distance between the upper edges 14 of the respective coupled floor panels 1 may vary and that said positioning means 23 only are operative when the coupled floor panels 1 are in danger of leaving this zone. According to the seventh aspect, the respective zones preferably are made free of overlap.

In the represented embodiment, in the first mutually locked position P1 as well as in the second mutually locked position P2, there is a bending-out B of said lower lip 17. It is clear that such bending-out B must be considered optional, both in the first and in the second mutually locked position P1-P2. It is clear that, however, by means of such bending-out B a restoring force in the sense of the first, second, third and/or the ninth aspect of the invention can be obtained.

Figure 22:
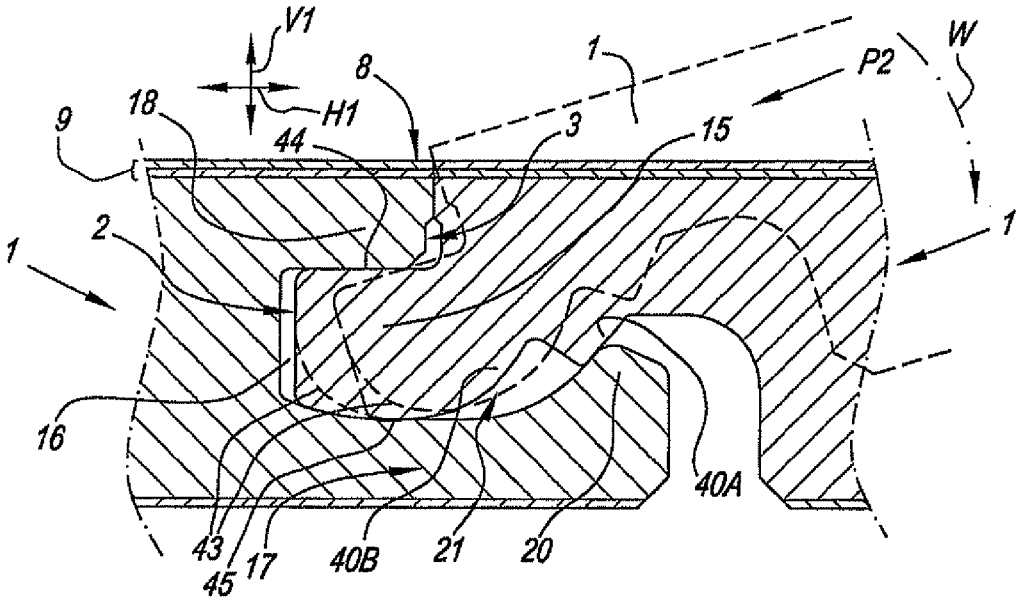

FIG. 22 represents another example of coupling means 6, which, amongst others, can be applied at least at two opposite sides 2-3 in floor panels 1 with the characteristics of said seventh aspect of the invention.

Figure 23:
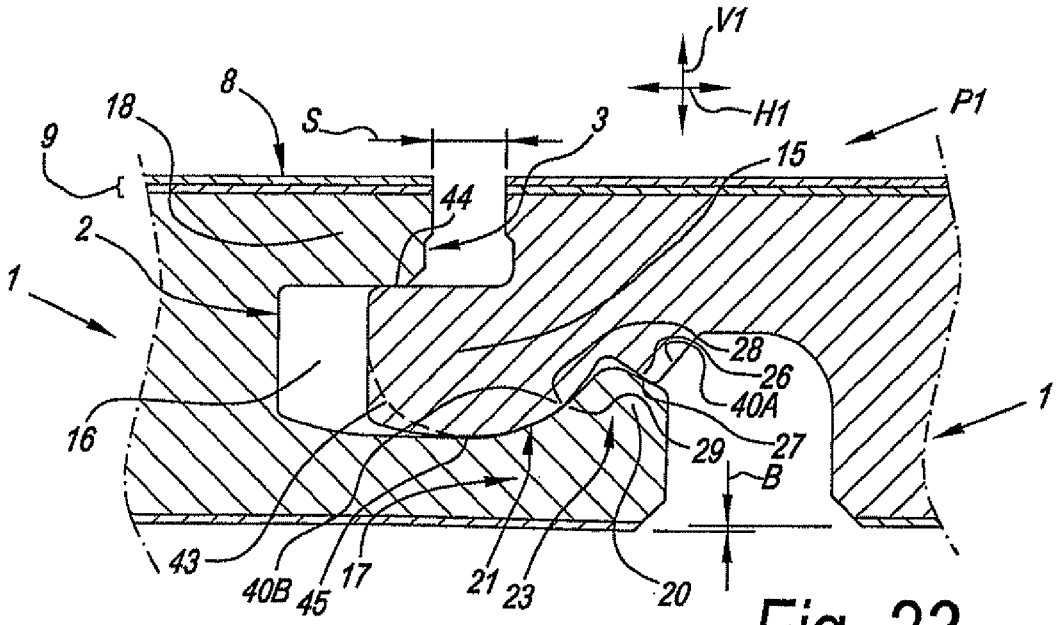

In this case the coupling means 6 also substantially are constructed as a tongue 15 and a groove 16, the latter being bordered by means of a lower lip 17 and an upper lip 18. The coupling means 6 also comprise locking means 20-21, which, in the example, are made in the form of a locking element 20 on the lower lip 17 and a cooperating-therewith locking element 21, which is present on the tongue 15, in this case on the underside 22 of the tongue 15. In this case, said locking element 21 on tongue 15 is made with several different locking portions 40A-40B, with which it can cooperate with said locking element 20 on the lower lip 17. Due to the presence of these locking portions 40A-40B, the coupling means 6 allow for that the floor panels 1 can adopt at least two different mutual locked positions P1-P2. The first and the second possible locking manners P1-P2 are represented in FIGS. 23 and 22, respectively. In this two mutual positions P1-P2, each time a locking is obtained in a vertical direction (V1) as well as in a horizontal direction (H1).

In the example, a bending-out B of the lower lip 17 can only be observed in said first mutual position P1. Further, it is also represented by the dashed line 43, that the design of, for example, the tongue 15, more particularly of the underside 22 of the tongue 15, can be adapted in order to have the coupling of the floor panels 1, in this case preferably by means of a turning movement W, occur more simple and/or with less pressure force.

It is noted that with the seventh aspect, it is of importance that the upper sides 8, upper surfaces or the upper edges 14 of the floor panels 1 in both mutual locked positions P1-P2 are situated substantially in the same horizontal plane. Also, it is preferred that in both mutual locked positions P1-P2 a connection free from play is obtained at least in vertical direction V1, and preferably also in horizontal direction H1. In order to obtain a connection that is free from play in vertical direction V1, it is desirable to make at least the contact surface 44 of the tongue with the upper lip 18 flat and preferably even horizontal or substantially horizontal. Still better, also the contact surface 45 of the tongue 15 with the lower lip 17 is made flat and preferably horizontal or substantially horizontal.

The mutual positions P1 represented in FIGS. 21 and 23 also illustrate that the floor panels 1 shown there may have the characteristics of said fifth aspect of the invention. To this aim, the space S must be chosen such that it defines a mutual distance of one to three millimeters between said upper edges 14. In these examples, the space S flanks the distal extremity of the upper lip 18 and thereby extends from the upper surface or the upper side 8 up to the tongue 15. Said proximal locking portion 40A functions in FIG. 21 as the stop portion mentioned in the fifth aspect, whereas in FIG. 23, the locking element 20 at the lower lip 17, more particularly the distal portion thereof, functions as a stop portion.

It is clear that, amongst others, FIGS. 2 to 5 as well as FIGS. 9 to 19 also form examples of, amongst others, said fourth and sixth aspects of the invention, when said space S is chosen such that it defines a mutual distance of one to three millimeters between the upper edges 14.

Further, it is evident for the person skilled in the art that by mutually combining the described embodiments and aspects and/or by combining these embodiments and aspects with the coupling means of the state of the art, for example, with the coupling means known from WO 97/47834, an embodiment with the characteristics of said eighth aspect of the invention can be obtained. Preferably, the embodiments and aspects described above are applied at the long sides of an oblong floor panel.

It is noted that according to all aspects of the invention, it is preferred to make the respective coupling means, locking means, positioning means and other portions of the coupling means and/or coupling parts in one piece with the floor panel, preferably to make them in one piece with the substrate of the floor panel.

It is also noted that, where in the above the presence of play in the coupling means 6 or in the connection in general is mentioned, it is intended that that there is a freedom of movement of the floor panels 1 or that, in other words, there is no or at least almost no immediate resistance against a movement of the floor panels 1 in a certain direction towards each other or away from each other. This does not exclude that after the bridging-over of the play distance, possibly a resistance against further movement in the same direction may exist and/or may be built up. In general, such play can be built-in in the coupling means 6 as a free play space R1-R2, and the floor panels 1 only have to overcome a possible friction force in order to be able to move over a certain distance in respect to each other. Such play space may also be formed by a material offering almost no mechanical resistance against compression. Of course, by "free from play" then is intended that indeed an instantaneous resistance is present or is built up against a movement of the floor panels 1 in a certain direction towards each other or away from each other, which resistance at least counteracts and possibly prevents such movement. This still allows that, when exerting a sufficiently large force, a mutual movement of the floor panels 1 can take place, such as this is the case, amongst others, with the free-from-play embodiments of the first through the third aspects. By instantaneous is meant that said resistance already exists or is created with a limited movement of the floor panels 1. Preferably, such resistance with free-from-play coupling means 6 already is created with a movement away from each other or towards each other over a distance which is smaller than 0.2 mm and still better is smaller than 0.1 or 0.05 mm.

Figure 24:
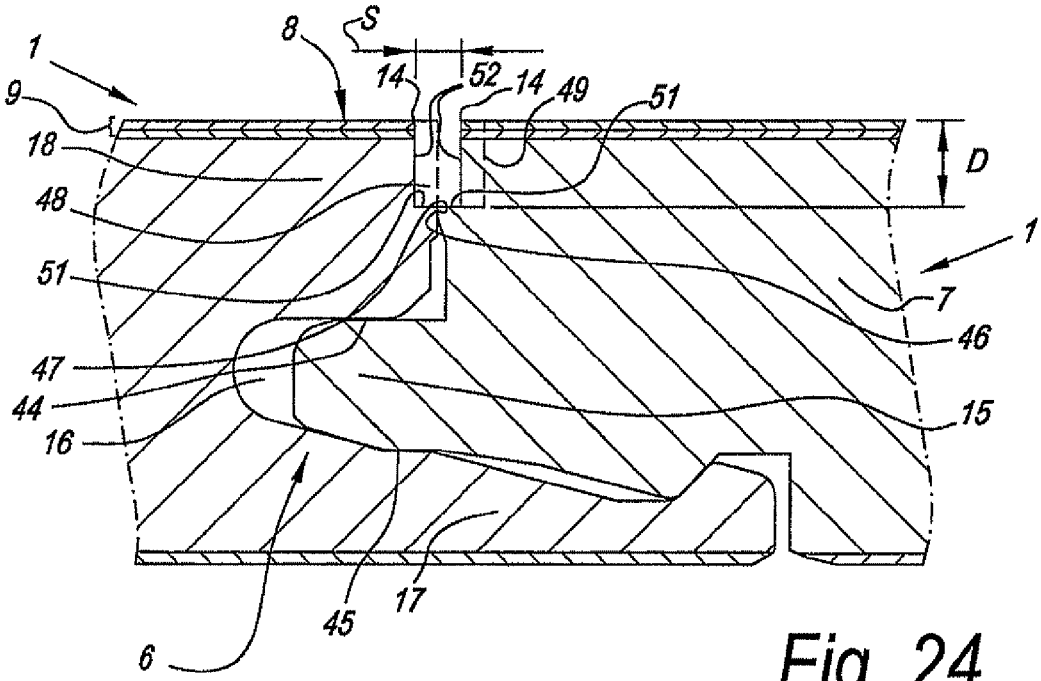
FIG. 24, in a view similar to that of FIG. 23, forms an illustration of a floor panel with, amongst others, the characteristics of the fourth independent aspect of the invention.

FIG. 24 shows another example of floor panels 1 showing, at least at two opposite sides 2-3 or 4-5, coupling means 6 by means of which they cooperate with each other. In the represented coupled condition of the respective floor panels 1, the coupling means 6 provide for a locking in a vertical direction V1 as well as in a horizontal direction H1. Herein, the coupled condition relates to a condition in which the upper edges 14 of the floor panels 1 substantially are situated in the same horizontal plane, in this case the horizontal plane formed by the upper side 8 or the upper surface of the floor panels, whereas a space S is present at the height of these upper edges 14, between the respective sides 2-3. The floor panels 1 are mutually locked free from play at least in said horizontal direction H1, and in this case, also in said vertical direction V1, and said space S defines a mutual distance of one to three millimeters between said upper edges 14.

The embodiment represented in FIG. 24 meets the second preferred embodiment of the fourth aspect of the invention, mentioned in the introduction. From the depicted coupled condition or mutual position, the floor panels 1 can not or hardly move towards each other. In this case, this is obtained in that in this mutual position, contact surfaces 46-47 are present, here positioned above the tongue 15 and the groove 16, however, beneath the upper surface or the upper side 8 of the floor panels 1. Said contact surfaces 46-47 are pressed in horizontal direction H1 against or into each other, when the tongue 15, from the depicted coupled condition, tends to shift further into the groove 16. During this pressing into or against each other there is, anyhow, not in the first place, no bending or deformation of the coupling means 6 or of portions thereof, which may allow a reduction of said space S, contrary to the bending occurring, for example, in the embodiments of the present invention illustrated in FIGS. 2 and 3.

In the example of FIG. 24, said gap S is formed by recesses 48 provided both at the groove panel and at the tongue panel. As the dashed line 49 shows, it is also possible that the gap S is formed by a recess 48 provided solely at one of both floor panels 1, either at the groove panel or at the tongue panel.

Figure 25:
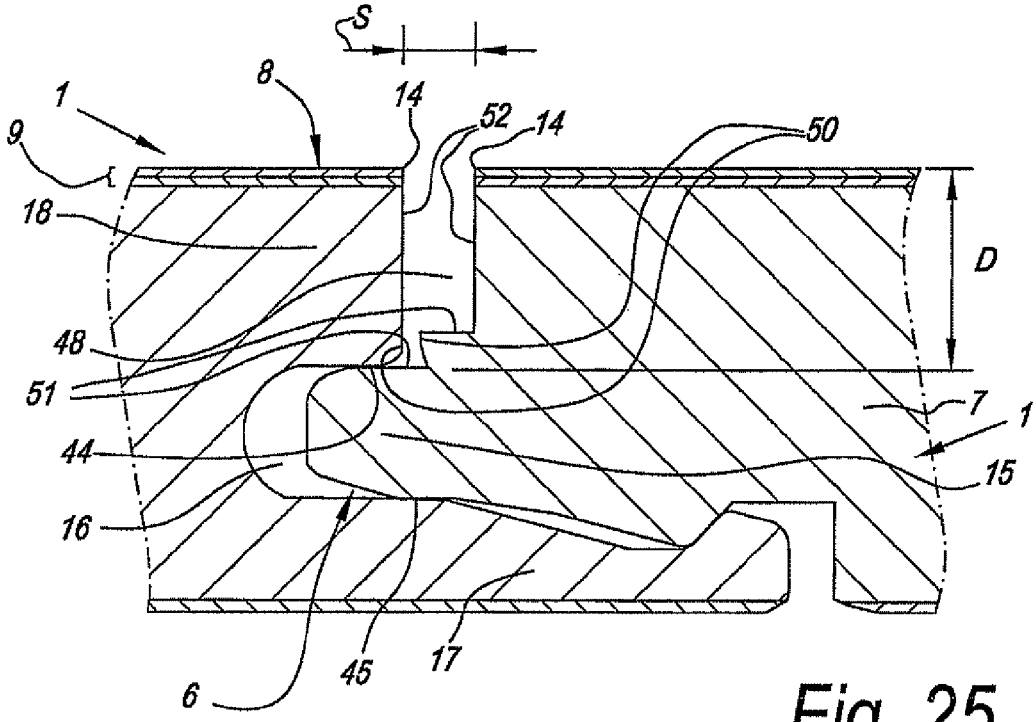
FIG. 25 represents a floor panel with, amongst others, the characteristics of the fifth aspect of the invention.

FIG. 25 shows another example of a floor panel 1 according to the present invention, wherein this floor panel 1 in particular shows the characteristics of the fifth aspect mentioned in the introduction. In a coupled condition of two of such floor panels 1, the coupling means 6 of the floor panels 1 provide for a locking in a vertical direction V1 as well as in a horizontal direction H1 and allow that the floor panels 1 can be locked in a mutual position, for example, the position here depicted, in which the upper edges 14 of the floor panels 1 substantially are situated in the same horizontal plane, in this case the upper surface or the upper side 8 of the floor panels 1, whereas a space is present between the respective sides 2-3. Herein, the space S flanks the distal extremity of the upper lip 1 of the groove 16 and thereby extends at least from the upper surface or the upper side 8 of the floor panels 1 up to the tongue 15. As here, it is preferred that the space S thereby extends at least up to a depth D in the floor panel 1 corresponding to the vertical position of a vertically active locking surface or contact surface 44, which is situated on the upper side of said tongue 15 and preferably cooperates with the underside of the upper lip 17 of the groove 16.

In said mutual position, the space S defines a mutual distance of one to three millimeters between said upper edges 14. The represented coupling means 6 are provided with stop portions 50 preventing a possible closing of the space S. In the represented example, the stop portions 50 are made such that a minimal space S is guaranteed, which defines a distance of at least 1 millimeter between the upper edges 14 of the floor panels 1.

It is noted that all aspects of the present invention can be applied to any kind of floor panels. This may relate, for example, to laminate floor panels, such as floor panels with a DPL top layer on a MDF or HDF substrate, wooden floor panels, such as solid parquet, composed floor panels, such as so-called "engineered wood", veneer parquet. Preferably, it relates to floor panels with a wooden top layer or a top layer at least representing wood. In this latter case, this may be, for example, a printed pattern in the form of a wood pattern. It is clear that the coupling means, locking means, positioning means, stop portions, and the like, which are mentioned in the different aspects of the invention, preferably are made in one piece with the floor panel, and still better are made in one piece with the possible substrate of such floor panel.

It is also clear that the present invention also relates to a floor covering composed of floor panels which are made according to one or more of the aforementioned aspects. It is clear that such floor covering may offer a variety of advantages, such as an acceptable behavior with shrinkage and expansion.

It is self-evident that, where in the above a changing environmental climate is mentioned, a change of temperature and/or air humidity is meant which usually may occur inside rooms. Herein, it is also known that mainly changing air humidity will influence the expansion and/or shrinkage of the floor covering.

Preferably, the gaps S of the floor panels 1 of the present invention show, over the majority of the length of the respective sides 2-3-4-5, a depth D being larger than the width thereof, and/or a depth D being such that the user can not or almost not observe the possible bottom 51, possibly including the lateral walls 52, of such gap or space S. Still better, one may work over the majority of the length of the gaps S with a width/depth ratio that is smaller than 75 percent, and still better is smaller than 50 percent. Possibly, for the artificial creation or increase of a depth effect, one may work with a dark, for example, a dark brown, black or gray coloration of said lateral walls 52 and/or bottom 51 of the gap S. In general, the gaps of the invention show over the majority of their length preferably a depth D of more than 1 millimeter, and still better of more than one and a half or 2 millimeters. It is clear that the width of the gap corresponds to said space S and is determined as the distance between the upper edges 14 of the floor panels 1, measured in a horizontal plane perpendicular to the respective side 2-3. The depth D of the gap preferably is determined by the distance, measured in a vertical plane, from the upper edges 14 of the floor panels 1 to the bottom 51 thereof or to the deepest point of the respective gap. The gaps of the present invention preferably show, over the majority of their length, steep, preferably substantially vertical, lateral walls 52, or at least lateral walls 52 having an inclination which, over the majority of the length of the respective side, is larger than 70°, and still better is larger than 80°, such that the gap or space, towards the surface or upper side 8 of the floor panel 1, varies in width only in a limited manner and/or that the gap does not give way to the impression to be a chamfer or a so-called V-groove. It is also not excluded that one works with walls 52 forming an undercut of the upper side 8 of the floor panels 1. With such undercutting lateral walls 52, particular depth effects may be achieved. It is clear that according to the invention, it is not necessary that the gaps or spaces have straight or even vertical walls 52. One may as well work with curved walls, such as concave or convex lateral walls 52.

Preferably, the gap bottom 51 substantially is made horizontal, although this is not necessarily the case.

Figure 26:
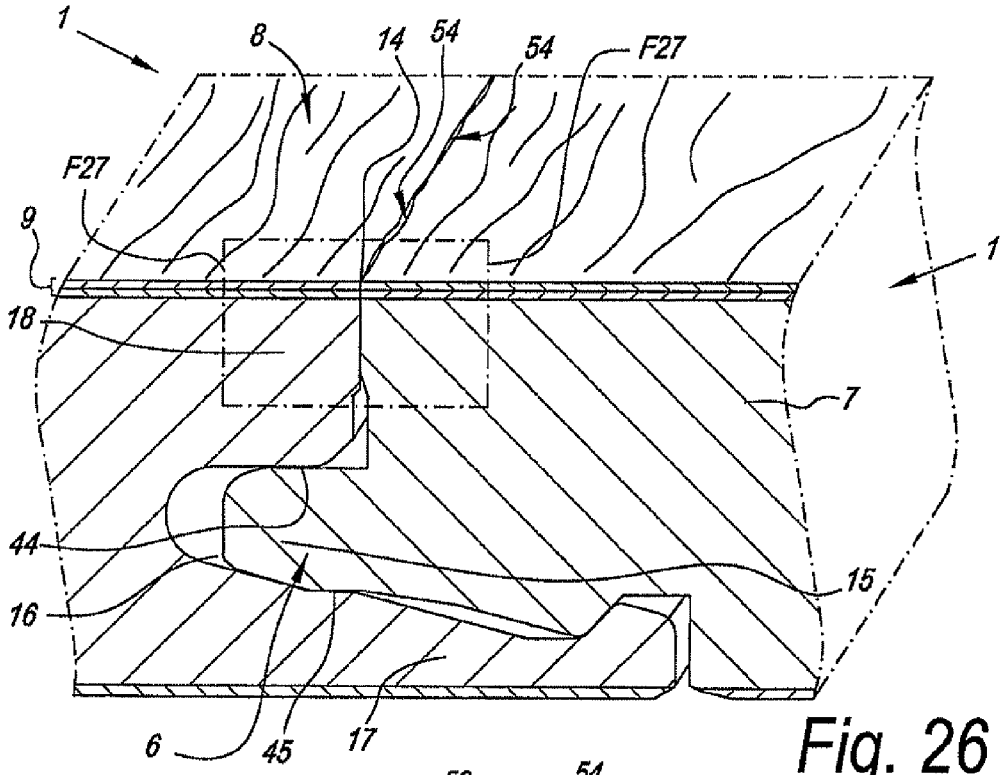
FIGS. 26 and 27, by means of the state of the art, illustrate several further advantages of the present invention, wherein FIG. 27 at a larger scale shows a view onto the area indicated by F27 in FIG. 26.

For illustration's sake, FIG. 26 shows coupled floor panels of the state of the art. Herein, this relates to floor panels 1 having a top layer 9 provided on a core 7, more particularly the example relates to laminate floor panels with a core 7 on the basis of porous material, such as MDF or HDF. The top layer 9 may have been obtained, for example, by means of a DPL method and may consist substantially of material sheets 12-13, such as paper sheets, provided with resin.

The floor panels 1 show, at least at the edges of two opposite sides 2-3, coupling means 6 made in one piece with the floor panel 1, more particularly made in one piece with the core 7, which coupling means provide for a locking between the respective floor panels 1 in a horizontal direction H1 as well as in a vertical direction V1. The connection obtained thereby is free from play in all directions in the plane of the FIG. 26. However, due to various reasons, it is possible that the upper edges 14 of the respective floor panels 1 do not always adjoin each other perfectly and that therefore tiny openings are present in the floor surface. This may be the case, for example, when the quality of the tools with which the coupling means 6 and/or the upper edge 14 have been realized, is not quite optimum and/or when the allowed machine tolerances during manufacture are too large, with the consequence that the obtained upper edge 14 is not made straight-lined enough and/or that the top layer 9 locally has crumbled away. The crumbling away of the top layer 9 is particularly frequent with laminate panels of the DPL type, as the hardened resin of the material sheets applied in the top layer 9 herein has a brittle character.

Figure 27:
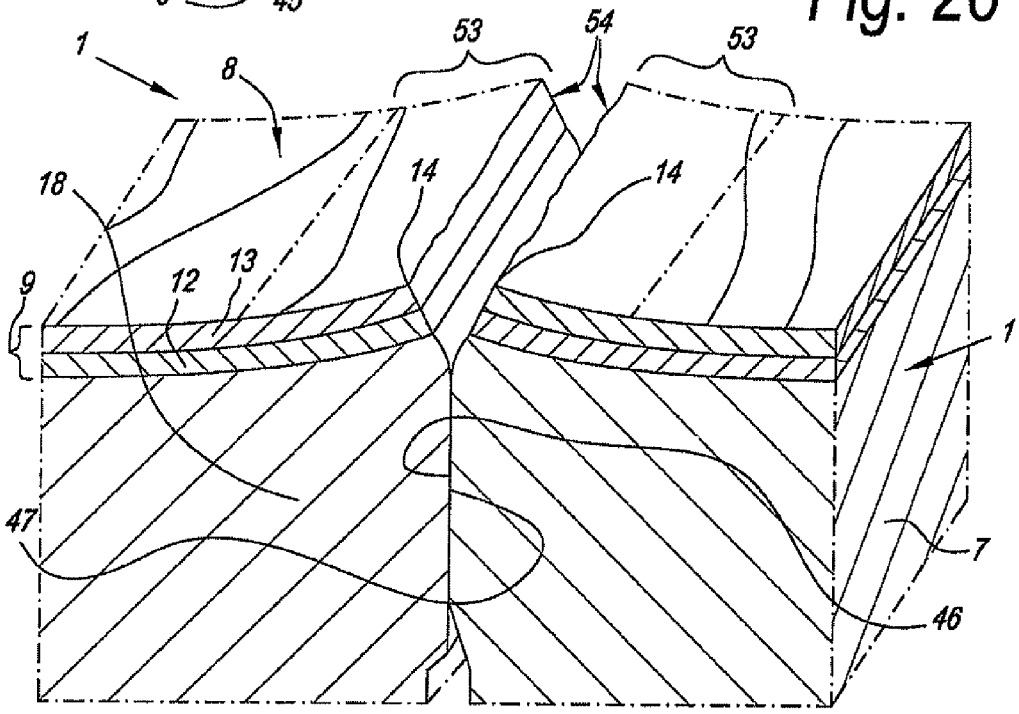

When the floor panel 1 of FIG. 26 is used in an inappropriate manner, for example, is installed in a humid room or is maintained too wet, moisture may penetrate via the aforementioned tiny openings into the core 7 or the substrate. FIG. 27 shows that as a consequence of such moisture penetration, the porous core 7 or the substrate directly under the upper edges 14 can swell such that the top layer 9 locally is pushed upward. Such pushed-up top layer 9 is not only esthetically unattractive, but increases the problem of moisture penetration outlined above, as this moisture now can reach the substrate more easily. The pushed-up areas 53 of the top layer 9 are strongly subjected to wear, and when such floor surface is often walked on, surely with laminate of the DPL type, matte or even white edges will be created, where the originally present decor is no longer visible or even has been worn down. It is also noted that, in the case of a DPL top layer, the lateral edge 54 of the laminate top layer 9 may even be present in the floor surface as a white border when a minimum swelling occurs, which is experienced as objectionable.

The floor panels 1 of the present invention, and in particular the floor panels 1 where under all circumstances a preferably large gap or space S is present, such as the floor panels 1 of said fourth or fifth aspect, are less susceptible to the above-described inappropriate use, as the moisture that possibly may penetrate via the gap with these floor panels 1 can be distributed over a larger portion of the substrate or the core 7, such that a better-distributed and thereby also lesser swelling of the substrate is created, which will push up the upper edges 14 less or not at all. Moreover, this better-distributed penetrated moisture can vaporize in an easier manner from the substrate or the porous core 7. It is clear that the substrate, at least at the height of the gap, may be provided with any layer restricting or preventing said possible moisture penetration. For examples of such coatings, reference is made to the international patent application PCT/IB2007/000987 of the applicant. The floor panels 1 of the present invention, where a gap, preferably a large gap, is present under all circumstances, moreover offer the advantage that a possible coating of the gap walls 52 does not have to hamper a good connection. In fact, the width of the gap S can offer enough space for applying one or more layers of such coating.

It is noted that the floor panels 1 according to all aspects of the present invention may be provided with gaps or imitation gaps in their actual upper surface or upper side 8, which gaps may be realized in any manner, for example, by forming impressions in this upper surface, by representing such gaps at this upper surface solely in a graphic manner and/or by removing a material portion from the upper surface, for example, from the possible top layer 9 and possibly from the substrate present directly therebelow or the core 7. For examples of gaps realized in the upper surface of a floor panel, reference is made to WO 2007/072198. The above-mentioned removal of a material portion from the top layer may take place by means of a mechanical tool, such as by a saw or a milling cutter, as well as by means of any other tool, such as by a laser. For this latter, reference is also made to WO 2006/090287, where the application of a laser for realizing surface structures, amongst others, in laminate floor panels, is described. Of course, such laser treatment may also be applied for other types of floor panels.

The present invention is in no way limited to the embodiments described by way of example and represented in the figures, on the contrary may such floor panels and floor coverings be realized according to various variants, without leaving the scope of the invention.

Thus, for example, the invention is not restricted to floatingly installed floor panels. It may also be applied with floor panels which are anchored to an underlying floor, for example, by means of glue, nails or other attachment means. With such floor coverings, there are also problems that may be attributed to expansion or shrinkage of the floor panels. Nevertheless, it is not excluded that the floor panels and floor coverings of the invention may offer still other advantages.

It is noted that according to all aspects of the invention and depending on the embodiment, the initial position of the coupled floor panels either may be an unambiguously determined position, which is determined by the coupling parts, or may be a zone, wherein a certain mobility among the coupled floor panels is possible without having already a restoring force occur. Examples of embodiments with an unambiguously determined initial position are, for example, FIGS. 6 and 7; an example of an embodiment wherein the initially coupled position relates to a zone allowing, as aforementioned, a certain mobility among the coupled panels, is represented in FIG. 8.

Apart from a possible solution for the problems outlined in the introduction, the present invention according to all of its aspects may also offer the advantage that it allows to absorb tolerance differences between different floor panels in one and the same floor covering. This is of particular importance when floor panels of different dimensions and/or shapes are combined, such as, for example, with the combination of square and oblong rectangular floor panels, wherein the width of the oblong floor panels preferably fits an integer number of times into the width of the square floor panels. Such floor covering is described, for example, in DE 20 2005 006 559 U1. In this kind of floor covering, the floor panels separately, the oblong as well as the square floor panels, normally are made with the same production tolerance. However, when a plurality of oblong floor panels are composed in order to cooperate with one or several square floor panels, said production tolerances may result in a bad alignment of the edges to be coupled. The possibility of moving the floor panels of the present invention in locked condition to a certain extent towards each other or away from each other makes it possible to always properly align said edge to be coupled.

The invention claimed is:

1. Floor panel of the type having, at least at two opposite sides, coupling means allowing that two of such floor panels can cooperate with each other, whereby these coupling means, in a coupled condition of two of such floor panels, provide for a locking in a vertical direction perpendicular to the plane defined by the coupled floor panels, as well as in a horizontal direction perpendicular to the respective sides and in the plane of the coupled floor panels, whereby said coupling means allow that two of such floor panels can be locked in a mutual position in which the upper edges of the respective floor panels are situated substantially in the same horizontal plane, whereas a space is present at the height of these upper edges, between the respective sides, wherein the respective coupled floor panels in said mutual position are mutually locked at least in said horizontal direction free from play and wherein said space defines a mutual distance of one to three millimeters between said upper edges.

2. The floor panel of claim 1, wherein said coupling means comprise stop portions, which prevent a possible closing of said space.

3. The floor panel of claim 1 or 2, wherein said coupling means comprise positioning means, wherein these positioning means always urge, bring, respectively, two of such floor panels during coupling into an initial locked mutual position, wherein the coupled floor panels can leave said initial mutual position by shifting in a locked condition in horizontal direction towards each other or away from each other.

4. Floor panel of the type having, at least at two opposite sides, coupling means allowing that two of such floor panels can cooperate with each other, wherein these coupling means substantially are made as a tongue and a groove, the latter being bordered by means of a lower lip and an upper lip, and wherein these coupling means also comprise locking means, which at least consist of a locking element that is present in or on said lips, and a cooperating-therewith locking element which is present in or on said tongue, wherein said coupling means, in a coupled condition of two of such floor panels, provide for a locking in a vertical direction perpendicular to the plane defined by the coupled floor panels, as well as in a horizontal direction perpendicular to the respective sides and in the plane of the coupled floor panels, wherein said coupling means allow that two of such floor panels can be locked in a mutual position in which the upper edges of the respective floor panels substantially are situated in the same horizontal plane, whereas a space is present between the respective sides, wherein this space flanks the distal extremity of said upper lip and thereby extends from the upper surface of the respective floor panels up to the tongue, wherein said space defines a mutual distance of one to three millimeters between said upper edges and wherein said coupling means comprise stop portions preventing a possible closing of said space.

5. The floor panel of claim 4, wherein said coupling means comprise positioning means, wherein these positioning means always urge, bring, respectively, two of such floor panels during coupling into an initial locked mutual position, wherein the coupled floor panels can leave said initial mutual position by shifting in a locked condition in horizontal direction towards each other or away from each other.

6. Floor panel of the type having, at least at two opposite sides, coupling means allowing that two of such floor panels can cooperate with each other, wherein said coupling means, in a coupled condition of two of such floor panels, provide for a locking in a vertical direction perpendicular to the plane defined by the coupled floor panels as well as in a horizontal direction perpendicular to the respective sides and in the plane of the coupled floor panels, wherein said coupling means comprise positioning means, wherein these positioning means always urge, bring, respectively, two of such floor panels during coupling into an initial locked mutual position, wherein the coupled floor panels can leave said initial mutual position by shifting in a locked condition in horizontal direction towards each other or away from each other, and wherein said initial locked position, upper edges of the respective floor panels substantially are situated in the same horizontal plane, whereas a space is present between the respective sides at the height of the upper edges of the coupled floor panels.

7. A floor covering comprising a plurality of floor panels of the type having, at a first pair of opposite sides as well as at a second pair of opposite sides, coupling means allowing that two of such floor panels can cooperate with each other, wherein these coupling means, in a locked condition of the respective sides, provide for a locking in a vertical direction perpendicular to the plane defined by the coupled floor panels as well as in a horizontal direction perpendicular to the respective sides and in the plane of the coupled floor panels, wherein in said coupled condition, a space is present at the opposite sides of said first pair between the respective upper edges, which space is at least larger than the possible space existing at the opposite sides of said second pair between the respective upper edges.

8. Floor panel of the type having, at least at two opposite sides, coupling means allowing that two of such floor panels can cooperate with each other, wherein these coupling means are made in one piece with the floor panel, and wherein these coupling means, in a coupled condition of two of such floor panels provide for a locking in a vertical direction perpendicular to the plane defined by the coupled floor panels as well as in a horizontal direction perpendicular to the respective sides and in the plane of the coupled floor panels, wherein said coupling means comprise positioning means, wherein these positioning means urge, bring, respectively, two of such floor panels during coupling into an initial locked mutual position, wherein the coupled floor panels may leave the aforementioned initial mutual position by shifting in a locked condition in horizontal direction towards each other or away from each other, and wherein said coupling means, when the coupled floor panels leave said initial mutual position, in a movement towards each other as well as in a movement away from each other, provide for a restoring force towards said initial mutual position.

9. The floor panel of claim 8, wherein in said initial locked mutual position, a space is present between the respective sides at the height of the upper edges of the coupled floor panels.

10. Floor panel of the type having, at least at two opposite sides, coupling means allowing that two of such floor panels can cooperate with each other, which substantially are made in the form of a tongue and a groove, the latter being bordered by means of a lower lip and an upper lip, and which, in a coupled condition of two of such floor panels, provide for a locking in a vertical direction perpendicular to the plane defined by the coupled floor panels, wherein said coupling means also comprise locking means, which, in a coupled condition of two of such floor panels, provide for a locking in a horizontal direction perpendicular to the respective sides and in the plane of the coupled floor panels, wherein said coupling means are provided with positioning portions, amongst which at least a positioning portion on one of said lips, and a positioning portion cooperating therewith on said tongue, wherein said positioning portions cooperate in such a manner that, when coupling two of such floor panels, an initial locked mutual position is obtained, wherein the coupled floor panels can leave said initial mutual position by shifting in a locked position in horizontal direction towards each other as well as by shifting away from each other, and wherein said cooperating positioning portions show at least a first pair of mutually cooperating positioning surfaces, by means of which a restoring force towards the initial mutual position is exerted when the coupled floor panels move towards each other from their said initial position.

11. The floor panel of claim 10, wherein in said initial mutual position, a space is present between the respective sides at the height of the upper edges of the coupled floor panels.

12. The floor panel of claim 10 or 11, wherein also when the coupled floor panels move from said initial position away from each other, there is a restoring force towards the initial position.

13. Floor panel of the type having, at least at two opposite sides, coupling means allowing that two of such floor panels can cooperate with each other, which substantially are made in the form of a tongue and a groove, the latter being bordered by means of a lower lip and an upper lip, and which, in a coupled condition of two of such floor panels, provide for a locking in a vertical direction perpendicular to the plane defined by the coupled floor panels, wherein said coupling means also comprise locking means, which, in a coupled condition of two of such floor panels, provide for a locking in a horizontal direction perpendicular to the respective sides and in the plane of the coupled floor panels, wherein at least one of said lips bordering said groove is elastically bendable, wherein said locking means cooperate in such a manner that, when coupling two of such floor panels, an initial locked mutual position is obtained, wherein the coupled floor panels can leave said initial mutual position by shifting in a locked condition in horizontal direction towards each other as well as by shifting away from each other, and wherein at least said bendable lip and possibly said cooperating locking means provide for a restoring force towards said initial position, when the coupled floor panels leave said initial mutual position, with a movement towards each other as well as with a movement away from each other.

14. The floor panel of claim 13, wherein said locking means consist at least of a locking element, which is present in or on said elastically bendable lip, and a locking element, cooperating therewith, which is present in or on the tongue.

15. Floor panel of the type having, at least at two opposite sides, coupling means allowing that two of such floor panels can cooperate with each other, which substantially are made in the form of a tongue and a groove, the latter being bordered by means of a lower lip and an upper lip, and which, in a coupled condition of two of such floor panels, provide for a locking in a vertical direction perpendicular to the plane defined by the coupled floor panels, wherein said coupling means also comprise locking means, which, in a coupled condition of two of such floor panels, provide for a locking in a horizontal direction perpendicular to the respective sides and in the plane of the coupled floor panels, wherein the floor panel at the respective opposite sides also comprises positioning portions, which cooperate such that, when coupling two of such floor panels, an initial locked mutual position is created, wherein the coupled floor panels can leave said initial mutual position by shifting in a locked condition in horizontal direction towards each other as well as by shifting away from each other; that, when the coupled floor panels leave said initial mutual position, with a movement towards each other as well as with a movement away from each other, there is a restoring force towards said initial position; and wherein said restoring force, with a displacement of the floor panels away from each other out of the initial mutual position, is larger than with an equally large displacement of the floor panels out of the initial mutual position towards each other.

16. The floor panel of claim 15, wherein the floor panel substantially is constructed of a material having at least one direction in which this material, under the influence of temperature changes and/or changes in air humidity, shows less dimensional deformations, such as expansion or shrinkage, than in other directions.

17. The floor panel of the claim 1, 4, 6, 7, 8, 10, 13, or 15, wherein the floor panel substantially is constructed of a material substantially consisting of wood fibers.

* * * * *